US007197862B2

(12) United States Patent
Daoust et al.

(10) Patent No.: US 7,197,862 B2
(45) **Date of Patent: *Apr. 3, 2007**

(54) LOG BANDER APPARATUS AND METHOD

(75) Inventors: James M. Daoust, Ashland, WI (US); Joseph A. Yachinich, Ashland, WI (US); Dennis P. Couturier, Washburn, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 6 days.

This patent is subject to a terminal disclaimer.

(21) Appl. No.: 11/081,012

(22) Filed: Mar. 15, 2005

(65) Prior Publication Data

US 2005/0241276 A1 Nov. 3, 2005

Related U.S. Application Data

(63) Continuation of application No. 10/427,730, filed on May 1, 2003, now Pat. No. 6,865,862, which is a continuation-in-part of application No. 09/716,374, filed on Nov. 20, 2000, now abandoned.

(51) Int. Cl.
*B65B 11/06* (2006.01)
*B65B 63/02* (2006.01)

(52) U.S. Cl. ..... 53/529; 53/228; 53/389.1

(58) Field of Classification Search ..... 53/438, 53/529, 466, 228, 209, 389.1, 389.3
See application file for complete search history.

(56) References Cited

U.S. PATENT DOCUMENTS 1,816,085 A 7/1931 Langhammer
2,006,116 A 6/1935 Schmiedel
2,177,773 A 10/1939 Heft et al.
2,894,363 A 7/1959 Voogd
3,327,449 A * 6/1967 Hullhorst et al. ..... 53/438
3,501,889 A 3/1970 Grulich et al.
3,543,471 A 12/1970 Youngman
3,585,776 A 6/1971 Euwe
3,619,976 A * 11/1971 Kerker ..... 53/528
3,650,087 A 3/1972 Brinkmeier et al.
3,845,948 A 11/1974 Furbeck et al.
3,958,392 A 5/1976 Beninger
3,986,319 A 10/1976 Puskarz et al.
4,078,363 A 3/1978 Ranzi
4,095,394 A 6/1978 Evrard
4,141,193 A * 2/1979 Joa ..... 53/529
4,165,595 A 8/1979 Pilley et al.

(Continued)

FOREIGN PATENT DOCUMENTS

JP 01037302 A 2/1989

*Primary Examiner*—Stephen F Gerrity
(74) *Attorney, Agent, or Firm*—Michael Best & Friedrich LLP

(57) ABSTRACT

A log packaging apparatus for packaging logs using a turret or a shuttle. The turret or shuttle can be used in conjunction with a wrap conveyor. The turret system can include a rotatable turret with at least one clamp movable into different positions in the apparatus, a log station at which logs are received, and a log ejector for ejecting logs from the log station into clamps of the turret. Logs can be ejected from the log station, through wrap material, and into the turret clamps. In other embodiments, a wrap conveyor inserts wrap material between a shuttle and a log station at which logs are received. Logs in such embodiments can pass from the log station to the shuttle through the wrap material.

27 Claims, 15 Drawing Sheets

U.S. PATENT DOCUMENTS 4,186,544 A 2/1980 Johnson
4,386,997 A 6/1983 Molitor et al.
4,408,435 A 10/1983 Sutton
4,408,438 A 10/1983 Rewitzer
4,450,669 A 5/1984 Rapparini
4,460,088 A 7/1984 Rugenstein et al.
4,464,883 A 8/1984 Glover
4,471,865 A 9/1984 Johnson
4,514,964 A 5/1985 Langen
4,574,565 A 3/1986 Gambetti
4,650,450 A 3/1987 Aiuola et al.
4,679,379 A 7/1987 Cassoli
4,696,146 A 9/1987 Esch et al.
4,790,115 A 12/1988 Focke
4,845,924 A 7/1989 Focke et al.
4,854,108 A 8/1989 Cassoli
4,862,673 A 9/1989 Francioni
4,870,807 A 10/1989 Palamides et al.
4,947,623 A 8/1990 Saito et al.
5,009,055 A * 4/1991 Simmons ..... 53/466
5,046,258 A 9/1991 Cahill et al.
5,046,297 A 9/1991 Lippert et al.
5,074,745 A 12/1991 Neri
5,133,173 A 7/1992 Draghetti et al.
5,175,981 A 1/1993 Gombos
5,301,489 A 4/1994 Beneditti
5,406,774 A 4/1995 Dodge
5,423,161 A 6/1995 Huson et al.
5,426,913 A 6/1995 Iriarte
5,452,561 A 9/1995 Thompson et al.
5,457,932 A 10/1995 Spada et al.
5,459,979 A 10/1995 Tommasi
5,465,554 A 11/1995 Lewis et al.
5,499,489 A 3/1996 Perobelli et al.
5,515,667 A 5/1996 Roosli
5,566,531 A 10/1996 Nordstrom et al.
5,605,027 A 2/1997 Scroggin et al.
5,634,321 A 6/1997 Martin-Cocher et al.
5,694,738 A 12/1997 Shigeta
5,694,742 A 12/1997 Elliott et al.
5,701,723 A 12/1997 Simpson
5,701,725 A 12/1997 Neri et al.
5,732,533 A 3/1998 Focke et al.
5,735,104 A 4/1998 Odenthal
5,765,335 A 6/1998 Simionato
5,863,380 A 1/1999 Gambetti
5,893,258 A 4/1999 Lancaster, III
5,916,107 A 6/1999 Zeyer
5,996,318 A 12/1999 Draghetti
6,000,199 A 12/1999 Boldrini
6,062,000 A 5/2000 Focke et al.
6,085,487 A 7/2000 De Vlaam
6,098,371 A 8/2000 Cassoli et al.
6,112,501 A 9/2000 Pollock
6,161,678 A 12/2000 Cassoli et al.
6,202,392 B1 3/2001 Greenwell et al.
6,308,497 B1 10/2001 Cassoli et al.
6,318,053 B1 11/2001 Frank et al.
6,550,221 B1 * 4/2003 Neri ..... 53/586
6,865,862 B2 * 3/2005 Daoust et al. ..... 53/529

* cited by examiner

LOG BANDER APPARATUS AND METHOD

CROSS-REFERENCE TO RELATED APPLICATIONS

This is a continuation of U.S. patent application Ser. No. 10/427,730, filed May 1, 2003, now U.S. Pat. No. 6,865,862, which is a continuation-in-part of U.S. patent application Ser. No. 09/716,374 filed on Nov. 20, 2000, now abandoned, the entire disclosures of which are incorporated herein by reference.

BACKGROUND OF THE INVENTION

Numerous systems and devices exist for packaging product in a variety of ways, including without limitation banders, wrapping machines, sleeve wrap machines, and the like. However, certain applications in which the product to be packaged is compressed prior to or during packaging can present machine design problems unique to those applications. Also, many applications require packaging speeds demanding fast and efficient machine operation. Packaging systems and devices capable of performing packaging operations at high speed and which handle, manipulate, and package product are typically quite complex and difficult to manufacture and repair. In addition, those systems and devices which handle, manipulate, and package compressed product can present unique design, maintenance, and repair challenges.

Due to their complexity, conventional product packaging systems are typically very compact and crowded, and therefore do not permit easy access to different system components therein for repair and maintenance. Such systems are also therefore difficult to clear when product jams or misfeeds occur or when system adjustments must be made.

The increased speeds at which existing product packaging systems are called to operate presents another problem. For example, interfolding and stacking equipment speed (upstream of stacked product packaging systems) is continually increasing with advancements in paper handling and processing technology. Therefore, many conventional stacked product packaging systems simply cannot be used at the very high product speeds becoming more common in connected paper processing and handling equipment.

The size and length of some product (e.g., logs of stacked paper products, rolls of product, and the like) presents still another problem. For example, many conventional sheet interfolding, web rewinding, product stacking, and other apparatuses produce relatively long logs which must then be packaged. This is particularly true in the paper products industry where a large volume of product is often processed simultaneously. The logs are often packaged, wrapped, bound, or tied with wrapping materials such as plastic sheets, binding straps, paper sheets, cellophane sheets, plastic strips, and the like. In applications in which the logs are particularly large, conventional packaging apparatuses have difficulty in wrapping the logs with potentially large sheets of wrapping material. In particular, it has often been difficult to insert large pieces of wrapping material into the wrapping apparatus without wrinkling, folding or tearing the wrapping material. Additionally, these relatively large sheets of wrapping material can make misfeeds and jamming even more likely.

In light of the problems and limitations of the prior art described above, a new product packaging apparatus and method would be welcome in the art.

SUMMARY OF THE INVENTION

Some embodiments of the present invention employ a turret system in conjunction with a log compression system to produce a simple log packaging apparatus capable of a higher packaged log output rate than prior art log packaging devices. The turret system in such embodiments can have a turret coupled to at least one turret clamp and rotatable to bring the turret clamps into different positions in the log packaging apparatus. In one position, a turret clamp can be located adjacent the log compression system and can receive compressed logs ejected from a log compression station. The log compression system can comprise a log compressor for compressing logs and a log ejector for ejecting logs from the log compression station. In some embodiments, the turret clamp is movable to a wrap sealing station in which wrap material about the log in the turret clamp is sealed. The wrap sealing station can include a log discharge station in which logs are ejected from the turret clamp to a log discharge system for transport to downstream operations. As used herein and in the appended claims, the term "sealing" means that at least some portion of the wrap material is affixed by a bonding material or element to some other portion of the wrap material (or in other embodiments, also or instead to the log), and does not indicate or imply that any particular amount of wrap material is used, to what extent the wrap material covers or encloses the log, or that the log is necessarily entirely enclosed in the wrap material.

The wrap system can include one or more adhesive applicators for applying a bonding material or element (e.g., glue, tape, etc.) to unsecured wrap material about the log in the turret clamp, and at least one tucker for manipulating the unsecured wrap material in bonding operations. The log discharge system in some cases is capable of maintaining log compression upon compressed logs received from the turret clamp.

The log compression system can receive logs of material from upstream operations via a log conveyor, which conveys each log to the log compression station in which a log compressor is moved to compress the log to a desired size. Upon reaching the desired size, the compressed log can be ejected from the log compression station (such as by a piston driven wall). In some embodiments, wrap material is fed into the log packaging apparatus to a position between and immediately adjacent to the log compression station and the turret clamp. Therefore, a compressed log ejected from the log compression station is pressed through the wrap material (which wraps at least partly about the log in so doing) and into the turret clamp. Because the turret clamp can be the same width as or only slightly wider than the compressed log, significant log decompression need not occur.

The log in the turret clamp can then be rotated by the turret to the wrap sealing station in which a tucker can fold unsecured wrap material in the turret clamp into place upon the log in the turret clamp. A bonding material can then be applied to the unsecured wrap material, after which time another tucker can fold another portion of unsecured wrap material in the turret clamp upon the bonding material to seal the log. In some embodiments, the turret clamp is then rotated by the turret to the log discharge station, within which an actuator of the turret clamp moves to eject the sealed log to the log discharge system.

Any number of turret clamps can be employed in the present invention. In some embodiments, multiple turret clamps are employed for significantly increasing the output of packaged logs from the apparatus. Also, some embodiments have extendible and retractable turret clamps for improved turret clamp positioning with respect to the various systems in the apparatus. Because the turret and turret clamps can move logs to different stations and systems in the apparatus, the various systems in the apparatus are much more accessible for assembly, maintenance, repair, and jam removal.

In some embodiments of the present invention, a log packaging apparatus having a compression system, a shuttle, and a wrap conveyor is provided, all of which cooperate to at least partially wrap a log in a wrap material. A first log conveyor can move logs from upstream operations to the log packaging apparatus. A second log conveyor can remove the logs from the first log conveyor and move the logs into the log compression system. Also, the log compression system can include a pressure surface and a compression actuator operable to move the pressure surface within a compression chamber.

In some cases, the second log conveyor removes the logs from the compression station, and can pass through a first opening in the compression chamber, contact the newly-compressed log, and move the newly-compressed log through a second opening in the compression chamber. In some embodiments, the second log conveyor also or alternatively moves the logs onto the shuttle.

Where employed, the shuttle can include a conventional carriage moveable along one or more tracks between a shuttle first position and a shuttle second position. In some embodiments, the shuttle first position is adjacent the log compression system and the shuttle second position is spaced a distance away from the compression system. When the shuttle is in the shuttle first position, the shuttle can receive logs from the compression system or alternatively from the second log conveyor. Once the log has been at least partially transferred to the shuttle, the shuttle can begin moving toward the shuttle second position, at which the log is transferred to other downstream operations not described further herein. The shuttle can then return to the shuttle first position to repeat the above-described process.

In some embodiments, as the shuttle alternately travels between the shuttle first and second positions, the wrap conveyor travels between the shuttle and the compression system or alternatively between the shuttle and the second log conveyor. The wrap conveyor can be moveable between a wrap conveyor first position and a wrap conveyor second position to selectively insert wrap material along the path of the logs as the logs are transferred to the shuttle. Although other wrap conveyor positions are possible, in some embodiments the wrap conveyor first position is adjacent to a wrap material source, while the wrap conveyor second position is spaced a distance from the wrap material source and is located between the shuttle and the compression system or alternatively between the shuttle and the second log conveyor.

When the wrap conveyor is in the wrap conveyor first position, the wrap conveyor draws a sheet of wrap material from the wrap material source. The wrap conveyor then travels to the wrap conveyor second position with the sheet of wrap material. The movement of the shuttle and the wrap conveyor can be coordinated so that the shuttle and the wrap conveyor do not collide as the shuttle moves from the shuttle first position to the shuttle second position and as the wrap conveyor moves from the wrap conveyor first position to the wrap conveyor second position. In some embodiments, the movement of the shuttle and the wrap conveyor are coordinated so that as the wrap conveyor moves into the wrap conveyor second position, the shuttle is not in the shuttle first position. In this manner, the wrap conveyor moves a sheet of wrap material into position between the shuttle and the compression system or between the second log conveyor and the shuttle. The wrap conveyor can then remain in the wrap conveyor second position as the shuttle returns to the shuttle first position. Subsequently, a log can be moved from the compression system to the shuttle or alternatively from the second log conveyor to the shuttle. As the log is moved onto the shuttle, the log contacts the sheet of wrap material and drags the sheet of wrap material away from the wrap conveyor and the wrap material source and onto the shuttle. Once the log is loaded onto the shuttle or is at least partially transferred from the compression system or the second log conveyor to the shuttle, the shuttle can begin to move back to the shuttle second position, thereby clearing a path for the wrap conveyor to return to the wrap conveyor first position.

In some embodiments, the wrap conveyor includes a telescoping arm which extends and retracts between the log conveyor first and second positions. Also, in some embodiments the wrap conveyor includes a gripper moveable to draw a sheet of wrap material from the material source. The gripper can hold the sheet of wrap material as the wrap conveyor moves into the wrap conveyor second position and can release the sheet of wrap material as the log pulls the sheet of wrap material onto the shuttle.

The sheets of wrap material can be perforated so that when a log contacts the sheet of wrap material, the sheet of wrap material can be more easily separated from the wrap material source. In other embodiments, cutting elements are located between the log conveyor first and second positions and are operable to cut the wrap material so that the sheet of wrap material can be drawn into the shuttle by the log. This motion can cause the logs to be at least partially wrapped in the sheets of wrap material.

As mentioned above, in some embodiments the logs drag sheets of wrap material away from the wrap conveyor and onto the shuttle. The shuttle can be adapted to receive the logs and the sheets of wrap material, and can be further adapted to wrap the wrap material around the logs as the logs enter the shuttle, thereby more fully enclosing the log in the wrap material. In some cases, the shuttle includes tuckers which wrap the wrap material around the log, thereby insuring that the wrap material is correctly positioned with respect to the log. More particularly, the tuckers can position the wrap material around the trailing edge of the log to ensure that the log is properly surrounded with wrap material.

Some embodiments of the present invention include an adhesive applicator, which can be located on the shuttle. In these embodiments, the adhesive applicator applies adhesive (e.g., glue, tape, etc.) to the log and/or to the sheet of wrap material prior to or while the log is being wrapped. Depending upon the particular application, multiple adhesive applicators can be used. The adhesive applicators can be substantially similar to the adhesive applicators described above. In alternative embodiments, the adhesive applicator can be located downstream from the shuttle and can be operable to apply adhesive to logs and/or to a sheet of wrap material as the log is moved away from the log packaging apparatus to downstream operations.

In some embodiments, the shuttle includes a product guide positioned on the shuttle along the intended path of the logs. The product guide can include a moveable guide element such as a roller, a wheel, a pulley, or a belt which helps to move the logs onto and through the shuttle as the shuttle moves the log from the compression station to downstream operations. The shuttle can include two or more product guides which are spaced along the intended path of the logs and act together or independently to move one or more logs through the shuttle. Alternatively, the product guide can operate with the second log conveyor to move the logs through the shuttle. In some embodiments, the product guide(s) can apply pressure to the logs to insure that the logs remain relatively compressed as the logs travel through the shuttle.

Although the description of the illustrated embodiments below refer to paper product being packaged according to the present invention, it should be noted that the present invention is equally applicable to packaging of non-paper products such as cellophane and other synthetic materials, fabric, woven and non-woven textiles and cloth, foil, etc., regardless of product porosity, density, and dimensions. Also, the present invention is equally applicable to packaging of products in other than stacked form, including without limitation rolled or wound product, fiber product, bundled product, and the like. Such product forms are also referred to hereinafter (and in the appended claims) as "logs". However, the term "log" does not indicate or imply any particular shape of product or number of individual units making up such product, and includes product which is defined by one or more units (e.g., napkins, towels, and the like) collectively taking virtually any shape, length, width, and depth.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
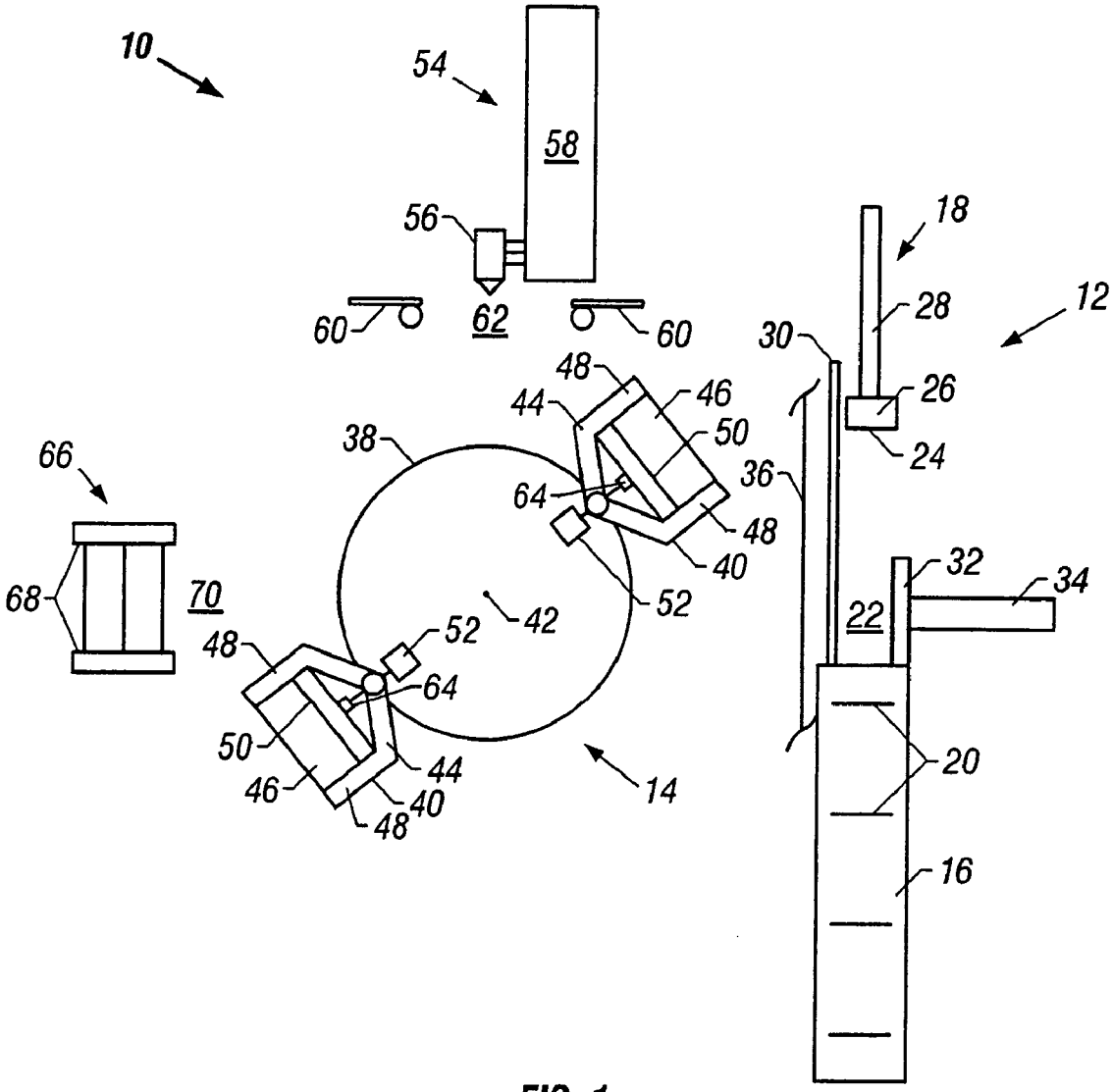
FIG. 1 is a plan view of the log packaging apparatus according to an embodiment of the present invention.

With reference first to FIG. 1, an exemplary embodiment of the log packaging apparatus 10 of the present invention includes a log compression system 12 and a turret system 14 which operate together to package bundles, rolls, logs, stacks, or other groups of product in a wrap material. By way of illustration only, the following description and accompanying figures show packaging operations of a stack of paper towels in a sleeve wrapper.

The log compression system 12 of the first illustrated embodiment includes a log conveyor 16 and a log compressor 18. The log conveyor 16 can be a conventional chain conveyor having a series of paddles 20 thereon for moving logs L from upstream equipment (such as a product stacker, interfolder, etc.) to a log compression station 22 adjacent to the log compressor 18. The paddles 20 are connected to chains of the log conveyor 16 in a conventional manner. Other well known types of log conveyors 16 can instead be used to convey product to the log compressor 18, including without limitation belt conveyors, cable and pulley or table-top conveyor systems, slide or turret conveyor systems, an elevator positioned beneath the log compression station 22, a series of powered or unpowered rollers, a slide or chute, and the like. Alternatively, the log conveyor 16 can be a moveable arm (not shown) which moves logs L from upstream operations to the log compressor 18, or can be a pusher plate (not shown) which pushes the logs L toward the log compressor 18 and is driven in any conventional manner, such as by a pneumatic or hydraulic piston, a screw drive, a chain or cable drivably connected to a motor, and the like. In short, any product conveyor device or assembly operable to move the logs L to the log compressor 18 can be employed.

The log compressor 18 in the illustrated embodiment comprises a piston connected to or having a pressure surface 24 facing the log compression station 22. The log compressor 18 can be hydraulically actuated in a conventional manner to move into and out of the log compression station 22, although pneumatic or other actuators can instead be used. Because the product being compressed in the illustrated embodiment of the present invention is a log of stacked paper towels, the pressure surface 24 can be a flat plate 26 connected to the end of a piston rod 28. The pressure surface 24 can be substantially parallel to the surface of the log conveyor 16 in order to generate proper compression forces upon a log L in the log compression station 22. Specifically, each log L placed in the log compression station 22 is compressed between the log compressor 18 and the surface of the log conveyor 16 when the log compressor 18 is moved toward and into the log compression station 22.

Although the flat plate 26 and piston rod 28 arrangement can be employed as described above and illustrated in the figures, many other well known pressure surfaces and pressure transmitting devices can be used if desired. Such surfaces can be defined by a plate, grate, rows of bars or rods, piston surface, and the like, and can be of a shape adapted for the type and form of product being compressed. For example, a concave grate can be used for compressing logs L of material in roll form, while a solid flat plate can be used to compress particulate material in the log compression station 22. It should be noted that the surface of the log conveyor 16 in some embodiments is shaped and takes a form similar to the pressure surface 24 of the log compressor 18 (e.g., concave if rolled products are compressed, flat and solid if particulate matter is compressed, and the like).

It will be recognized by one having ordinary skill in the art that many other types of compressing devices and assemblies can be used to compress logs L in the log compression station 22. Such compression devices and assemblies need not be hydraulically movable, and can operate under pneumatic, mechanical, or other power to compress logs L. For example, a pressure plate can be movable by a screw drive into and out of the log compression station 22, can be moved by a rack and pinion gear set, can be pressed against a log L in the log compression station 22 by cams rotated to press against the rear of the pressure plate 26, can be pressed by a conventional air, hydraulic, or magnetic ram, and the like. These alternative compression devices and assemblies are well known to those skilled in the art and fall within the spirit and scope of the present invention.

Although not required to practice the present invention, it is desirable to guide a log L into the log compression station 22 and to contain the log L therein during compression operations. For this purpose, a first wall 30 running alongside the log compression station 22 can be employed, and can be in facing relationship with a second wall 32 on an opposite side of the log compression station 22. The first wall 30 can be preferably movable (e.g., slidable, rotatable, and the like in any conventional manner) to permit a log L in the log compression station 22 to be ejected therefrom to downstream equipment as discussed in more detail below. In the illustrated embodiment of the present invention shown in FIGS. 1–11, the first wall 30 is slidable in an upward direction by a rack and pinion gear set (not shown) mounted to the top of the first wall 30 and powered by a motor (e.g., a stepper motor or other conventional motor capable of positioning operations). Many other wall movement devices well known to those skilled in the art can instead be used as desired.

The second wall 32 can be laterally movable across the log compression station 22 by one or more hydraulic pistons 34. Like the pressure surface 24 discussed above, numerous alternative devices and assemblies can be used to push the second wall 32 in such a manner, including without limitation pneumatic rams, rack and pinion gears, screw drives, and the like. Such alternative devices and assemblies are well known to those skilled in the art and fall within the spirit and scope of the present invention. When in a retracted state, the second wall 32 defines a side of the log compression station 22 and helps to contain a log L therein during compression operations. When the first wall 30 has been moved from beside the log compression station 22, the second wall 32 can be pushed by the piston 34 across the log compression station 22 to clear the log compression station 22 and to eject a compressed log L located therein. Both walls 30, 32 can take almost any shape desired, and in some cases take shapes matching the shape of the log L within the log compression station 22. Also, both walls 30, 32 can be replaced by structure or elements performing the same containing and guiding functions of walls 30, 32 and the ejecting function of wall 32. For example, either or both walls 30, 32 can be replaced by bars running alongside the log compression station 22, by a series of bars, poles, rods, tubes and the like arranged to form gates beside the log compression station 22, etc.

A sleeve feed path through which sleeve packaging material 36 passes into the log packaging apparatus 10 can be located beside the log compression system 12. Specifically, sleeve packaging material 36 can be fed into the log packaging apparatus 10 horizontally (i.e., into the plane of the page of FIGS. 1–11) in a manner well known to those skilled in the art by a conventional sleeve feed apparatus (not shown). The feed path of the sleeve packaging material 36 can be located with respect to logs L ejected from the log compression station 22 so that the logs L are pressed into the sleeve packaging material 36. In some embodiments, sleeve packaging material 36 is fed into the log packaging apparatus 10 in long strips which are substantially the same length of the logs L being packaged. As discussed in more detail below, other types of packaging material can be used in the apparatus 10 for packaging logs L in different manners, such as by banding logs, bagging logs, and the like. A number of packaging material feed apparatuses for each such packaging material are well known to those skilled in the art and are not therefore described further herein with reference to the first illustrated embodiment. However, each such apparatus can feed the packaging material to a location immediately adjacent to the log compression station 22 for receiving logs L as will be described below.

With continued reference to FIG. 1, the log packaging apparatus 10 of some embodiments of the present invention also includes a turret system 14 which includes a turret 38 upon which is mounted at least one turret clamp 40. In the illustrated embodiment shown in FIGS. 1–12, the turret 38 includes two turret clamps 40 located on opposite sides of the turret 38. The turret 38 is mounted in a conventional fashion to preferably rotate about a horizontal axis 42 in a controlled manner via a motor (not shown). The motor (e.g., a stepper motor or other conventional motor capable of performing positioning operations) is controllable to position the turret clamps 40 on the turret 38 in different circumferential positions about the axis 42. Such turrets 38 are well known in the art and are not therefore described further herein.

Each of the turret clamps 40 includes a log receptacle 46 which is of sufficient size to receive a log L therein. In some cases, each of the turret clamps 40 is shaped to match the shape of compressed logs L from the log compression station 22. Because the turret clamps 40 of the illustrated embodiment receives long logs L having a rectangular cross section (i.e., long logs of stacked paper towels), the turret clamps 40 each have a box-shaped log receptacle 46 as shown. In other embodiments of the log packaging apparatus 10 where logs L of a different shape are packaged, the log receptacles 46 can be shaped differently, such as a log receptacle 46 having a square cross sectional shape for square logs, a U-shaped log receptacle for round logs, and the like.

The log receptacle 46 can be defined at least in part by two opposing surfaces between which compressed logs L are received. The opposing surfaces can take a number of different forms capable of receiving and retaining a compressed log L therebetween, including without limitation plates, fingers, posts, and the like. In the embodiment shown in FIGS. 1–11, two opposing plates 48 are attached to a frame 44 consisting of a series of connected arms extending from the plates 48 as shown. Although not required, the log receptacle 46 of each turret clamp 40 is also defined by a back surface 50. The back surface 50 can be one or more plates, bars, rails, and the like located between the opposing surfaces (i.e., between the opposing plates 48) of the turret clamp 40, and can even be part of the turret clamp frame 44. The back surface 50 can function to properly locate logs L in the log receptacle 46 of each turret clamp 40 and to support logs L in position in the log receptacle 46 of each turret clamp 40. In the embodiment shown in FIGS. 1–11, the back surface 50 is an elongated flat plate running substantially the entire length of the turret clamp 40 for retaining and supporting a rectangular log L of product in the turret clamp 40. However, like the plates 48, the back surface 50 can be in any desired shape and can be shaped to match the shape of a log L in the log receptacle 46.

In some embodiments, each turret clamp 40 is extendable and retractable in its position on the turret 38 as shown in FIG. 1. Turret clamp extension and retraction can be accomplished in a number of different manners, such as by an actuator, (electrical solenoids, hydraulic or pneumatic pistons, and the like) track or rail assemblies upon which the turret clamps 40 are mounted to slide by conventional actuation devices, cable and pulley assemblies or gear assemblies, etc. In the embodiment shown in FIG. 1, each turret clamp 40 is mounted to an electrical solenoid 52 which is itself mounted to the turret 38. Specifically, an electrical solenoid 52 is connected to the frame 44 of each turret clamp 40 in a conventional manner. Each solenoid 52 pushes its respective turret clamp 40 away from the turret 38 when actuated in one direction and pulls the turret clamp 40 back to the turret 38 when actuated in an opposite direction. Rather than employ an actuator which can be actuated in two directions, the turret clamp 40 can be biased in one position by a bias element such as an extension spring, magnets, and the like, and can be forced out of the position by actuation of a solenoid or other actuation device.

In order to eject logs L from the log receptacle 46 of the turret clamps 40, each turret clamp 40 can include a log ejector mechanism. The log ejector mechanism can function to push a log L from the log receptacle 46, and in some cases does so by moving the back surface 50 of the turret clamp 40. As shown in FIG. 1, the illustrated embodiment of the present invention includes an actuator 64 mounted between the frame 44 and the back surface 50 (e.g., a surface of a rear plate of the turret clamp 40). Like the electrical solenoid 52 actuatable to extend and retract the turret clamp 40, the actuator 64 can be an electrical actuator, and can instead take any of the forms mentioned above to push and pull the back surface 50 of the turret clamp 40. In addition, other conventional assemblies and devices capable of ejecting an object from a receptacle can instead be used in place of the movable back surface 50 and actuator 64 of the preferred embodiment described above. For example, one or more piston rods defining the back surface 50 or movable through apertures in the back surface 50 can be actuated to eject logs L from the turret clamp 40, one or more apertures through the back surface 50 can be connected to an air source to exert air pressure behind a log L in the turret clamp 40 and to thereby push the log L out of the turret clamp 40, etc. Such other ejection assemblies and devices and their manner of connection and operation are well known to those skilled in the art and fall within the spirit and scope of the present invention.

Some embodiments of the present invention include a wrap sealing system 54 located adjacent to a wrap sealing station 62 and the turret 38 as shown in FIG. 1. The wrap sealing system 54 can include an adhesive applicator 56 connected in a conventional manner to a source of adhesive 58, and at least one tucker 60. The adhesive applicator 56 can be one or more adhesive spray nozzles (only one which is visible in the figures, with others extending into the plane of the page behind the adhesive applicator shown) connected under pressure to a source of liquid glue 58. The adhesive applicator 56 can be oriented toward the wrap sealing station 62 to apply adhesive to a log L in a turret clamp 40 when positioned adjacent to the wrap sealing system 54 by rotation of the turret 38. Although spray nozzles are employed in the illustrated embodiment of FIGS. 1–11, numerous alternative glue application devices exist, including without limitation a drip nozzle guiding flowing glue to a line, series of dots, or other pattern of glue to wrap material of a log L in the wrap sealing station 62, a sponge, felt, brush, or roll applicator fed by one or more adhesive lines (in some cases, under pressure), a dip wire movable or pivotable between a dip tank of adhesive to wrap material of a log L in the wrap sealing station 62, and the like.

Similarly, other wrap bonding material can be employed in the present invention, including without limitation cohesive material (in which case the material can be applied to two areas of wrap material which are then brought together for bonding), tape applied by a conventional tape applicating device adjacent to the wrap sealing station 62, staples driven by a conventional stapling device, and the like. Depending at least in part upon the type of wrap material used, it is even possible to perform wrap sealing operations without adhesive, cohesive, fasteners, or other sealing materials applied at the wrap sealing station 62. Specifically, shrink wrap material and thermally bonding wrap material can be heated or otherwise bonded in a conventional manner to seal the wrap material. Wrap material can even be pre-treated or have bonding material already placed thereon so that sealing operations only require wrap material placement and/or folding in the wrap sealing station 62. Such other adhesive material, glue application devices, and manners of wrap sealing are well known to those skilled in the art and fall within the spirit and scope of the present invention.

As mentioned above, the wrap sealing system 54 can include at least one tucker 60. Some embodiments of the present invention have a tucker 60 on each side of the wrap sealing station 62. Each tucker 60 is a series of fingers, a plate, or other member movable adjacent to the wrap sealing station 62 to fold over or fold down wrap material as will be described in more detail below. In the embodiment illustrated in FIGS. 1–11, each tucker 60 is a series of fingers (only one of which is shown for each tucker 60 in the figures, the remaining fingers in each series extending into the plane of the figures) slidable adjacent to the wrap sealing station 62 in a conventional manner. Specifically, the fingers of each tucker 60 can face one another over the wrap sealing station 62 and can be actuated by one or more actuators (not shown) to slide to and from respective positions beside the wrap sealing station 62. The actuators moving the tuckers 60 in the illustrated embodiment of FIGS. 1–11 are electrical solenoids, but can be any device or assembly capable of extending and retracting the tuckers 60 adjacent to the wrap sealing station 62. It should be noted that the tuckers 60 need not necessarily slide as described above and illustrated in the figures, but can instead pivot or swing into their positions beside the wrap sealing station 62, simultaneously slide and pivot, etc. Fold over or fold down devices (such as fingers, plates, swing arms and like devices), their manner of connection, motion, and operation, and the actuators used to actuate such devices are well known to those skilled in the art and are therefore not described further herein. Such devices and their manner of connection, motion, actuation, and operation fall within the spirit and scope of the present invention.

The present invention can also include a log discharge system 66 located adjacent to the turret 38. The log discharge system 66 functions to receive logs L from the turret system 14 and to transport logs L to downstream equipment. Although not required in many cases, the log discharge system 66 can be capable of retaining compression upon logs L received from the turret system 14. Therefore, some embodiments of the present invention have a log discharge system 66 with two facing conveyor assemblies 68 between which logs L are received from the turret system 14. The conveyor assemblies 68 can be conventional conveyor belts extending away from the turret system 14 to downstream equipment. However, other well known conveyor devices and assemblies can instead be employed to receive and move logs L from the turret system 14.

Figure 2:
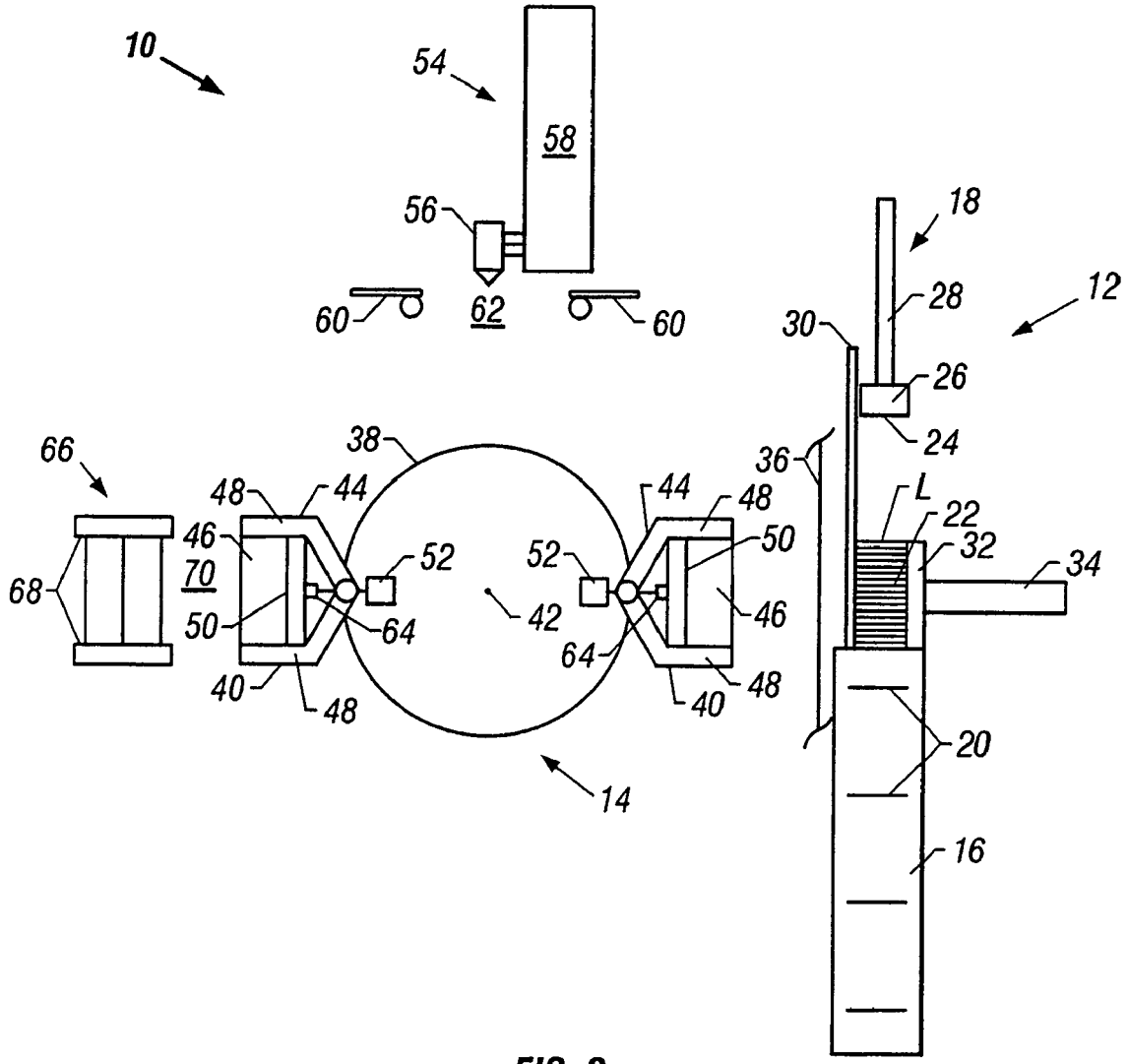
FIGS. 2–11 are plan views of the log packaging apparatus illustrated in FIG. 1, showing the apparatus in progressive steps of operation packaging a log.
Figure 3:
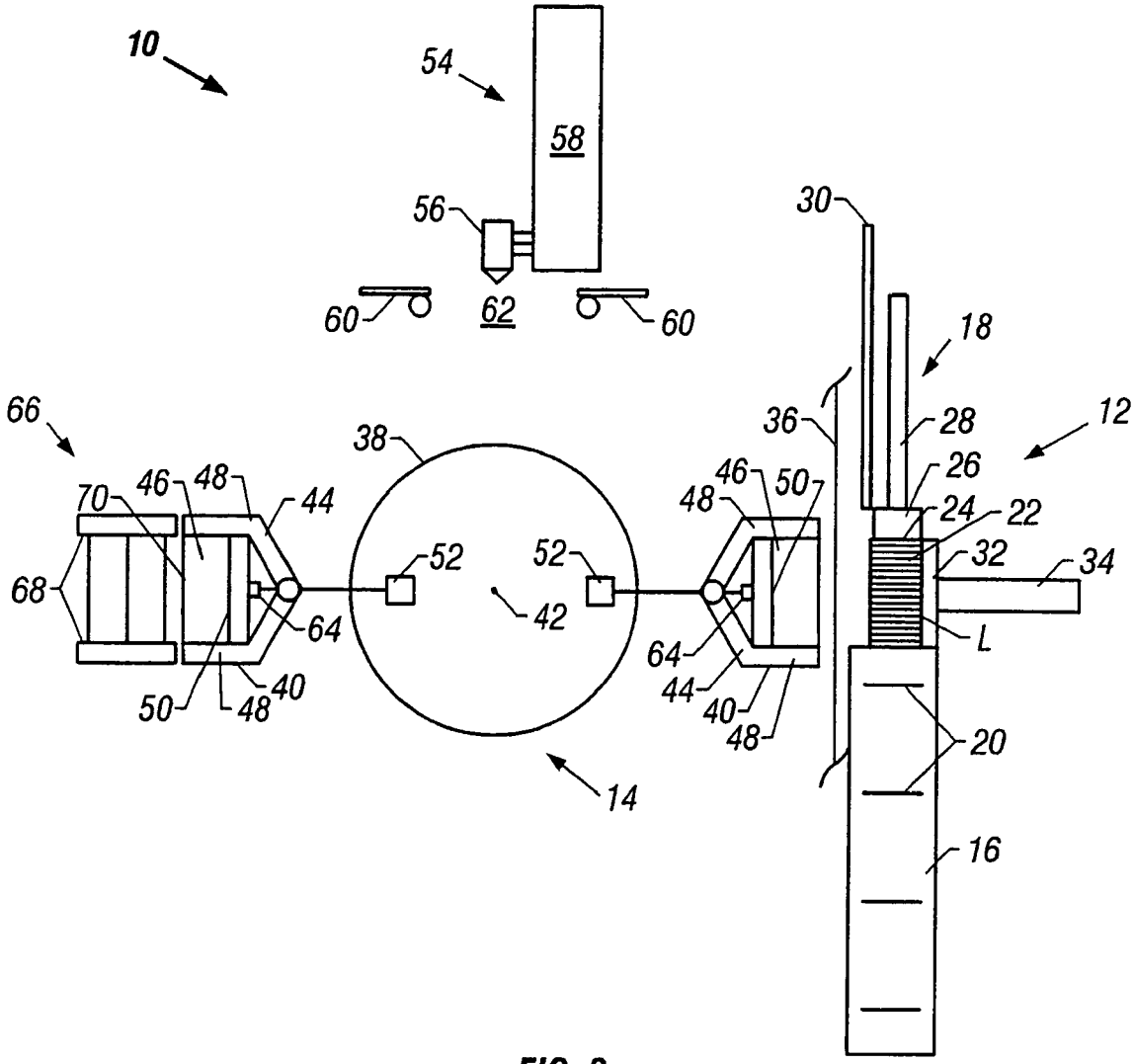

In operation of the illustrated exemplary log packaging apparatus of FIGS. 1–11 described above, a log L of a desired length (extending into the page of the figures) is fed into the log compression system via the log conveyor 16 as shown in FIG. 2. At this stage, the wall 30 is in its position beside the log compression station 22 and the piston rod 28 and the pressure surface 24 are retracted as shown in FIG. 2. Next, the piston rod 28 is extended to press the pressure surface 24 against the log L in the log compression station 22. Once a desired compression is reached or during log compression, the wall 30 can be moved as shown in FIG. 3 in preparation for log ejection from the log compression station 22.

Figure 4:
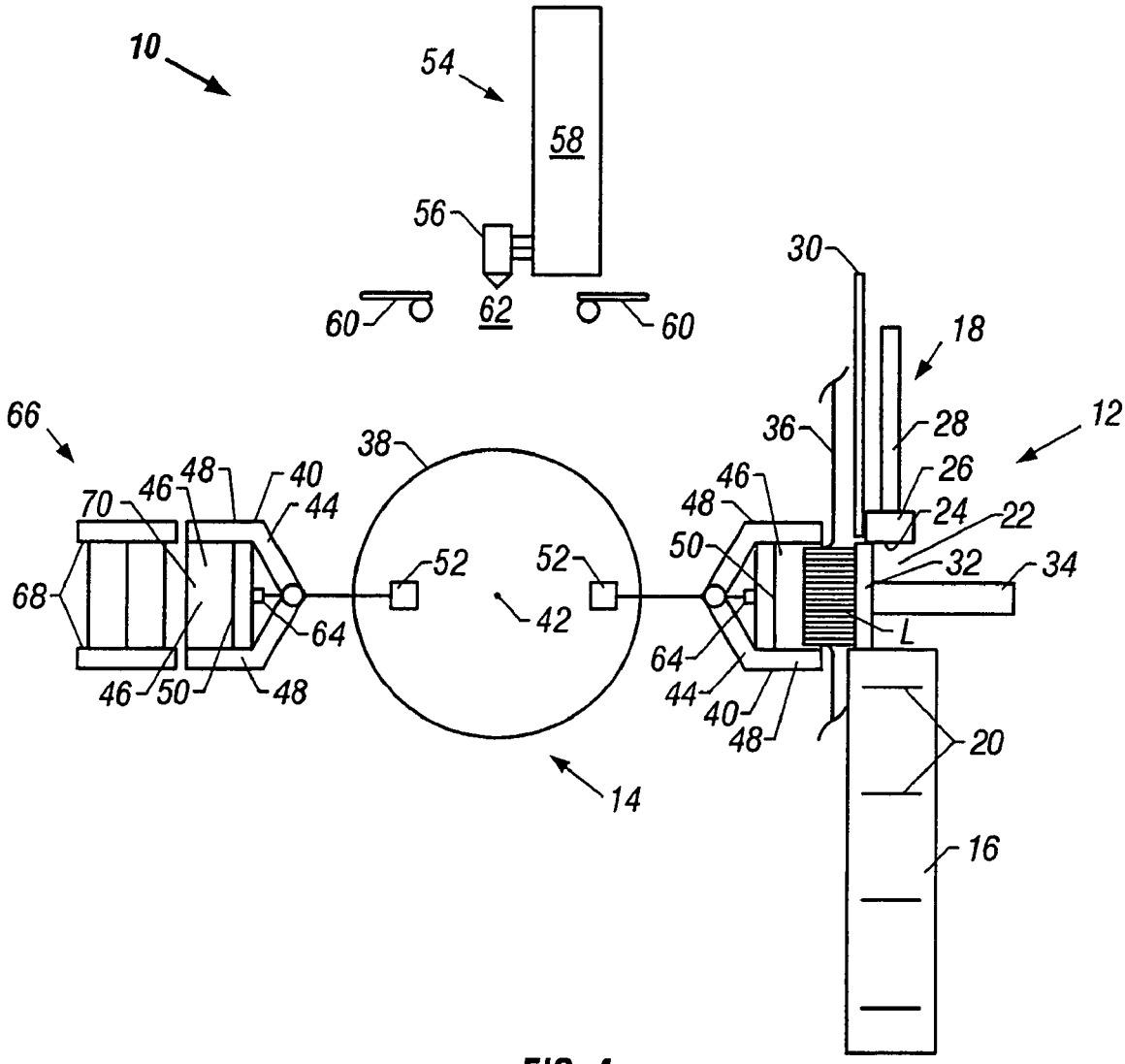

The piston 34 and wall 32 are then extended to push the log L out of the log compression station 22, into the wrap material 36 and into the turret clamp 40 aligned with the log compression station 22 as shown in FIG. 4. In some embodiments, the log L is not significantly decompressed by being ejected from the log compression station 22. However, to help insure smooth insertion of the log L into the turret clamp 40, the log receptacle 46 in the turret clamp 40 is the same width or slightly wider than the compressed log L so that the compressed log L easily fits within the turret clamp 40. For example, the plates 48 of the turret clamp 40 can be approximately 0.125 in. wider than the compressed log L. Because the compressed log L (e.g., of compressed stacked material) is pressed first into the wrap material 36 prior to or at the same time as being pressed into the turret clamp 40, the compressed log L is already partially wrapped when it enters the turret clamp 40, thereby also facilitating smooth insertion into the turret clamp 40. Specifically, the log L can press into and draw the wrap material 36 around itself as the log L enters the turret clamp 40. To this end, the wrap material 36 can be fed into the log packaging apparatus 10 closely beside the log compression station 22 to avoid significant log decompression prior to log entry into the turret clamp 40. For a similar reason, the turret clamp 40 (and more particularly, the plates 48 of the turret clamp 40 in the illustrated embodiment of FIGS. 1–11) can be rotated by the turret 38 to a station immediately adjacent to the log compression station 22 and the wrap material 36. A log L being ejected from the log compression station 22 can be immediately pressed into and through the wrap material 36 and between the plates 48 of the turret clamp 40.

It should be noted that in alternative embodiments of the present invention, the wrap material 36 can move toward and/or away from the log compression station 22 while or before a log L is ejected from the log compression station 22 into the turret clamp 40. Specifically, an alternative embodiment of the present invention can draw the wrap material 36 into the log receptacle 46 prior to or during log ejection from the log compression station 22. The wrap material 36 can be sucked into the log receptacle 46 by vacuum from vacuum apertures in the turret clamp 40 in fluid communication with a vacuum or suction source, one or more fluid jets (not shown) can be positioned adjacent to the log compression station 22 to blow the wrap material 36 into the log receptacle 46, and the like. Alternatively, many conventional systems move wrap material toward a stationary or moving object to be wrapped therein. After the wall 30 has been moved to permit log ejection as described above, such a system can be employed to move the wrap material 36 toward the log L in the log compression station 22 prior to or during log ejection. However, because the illustrated embodiment of the present invention in FIGS. 1–11 requires only wrap material feed and movement in one direction (e.g., closely adjacent to the log compression station 22), the above-described log ejection and log wrap operations are employed therein.

In some embodiments of the present invention, the opposing surfaces of the turret clamps 40 (e.g., the turret clamp plates 48 in the illustrated embodiment) are adjustable to increase or decrease the width of the log receptacle 46 for receiving logs L of different sizes. Adjustment can even be performed automatically based upon the size of a compressed log L measured in the log compression station 22 in any conventional manner, such as by one or more optical sensors, one or more sensors monitoring the amount of piston rod movement, and the like. Manual and automatic adjustment of the opposing surfaces is comparable to adjustment of robotic jaws, can be performed in numerous manners well known to those skilled in the art, and is therefore not discussed further herein.

Figure 5:
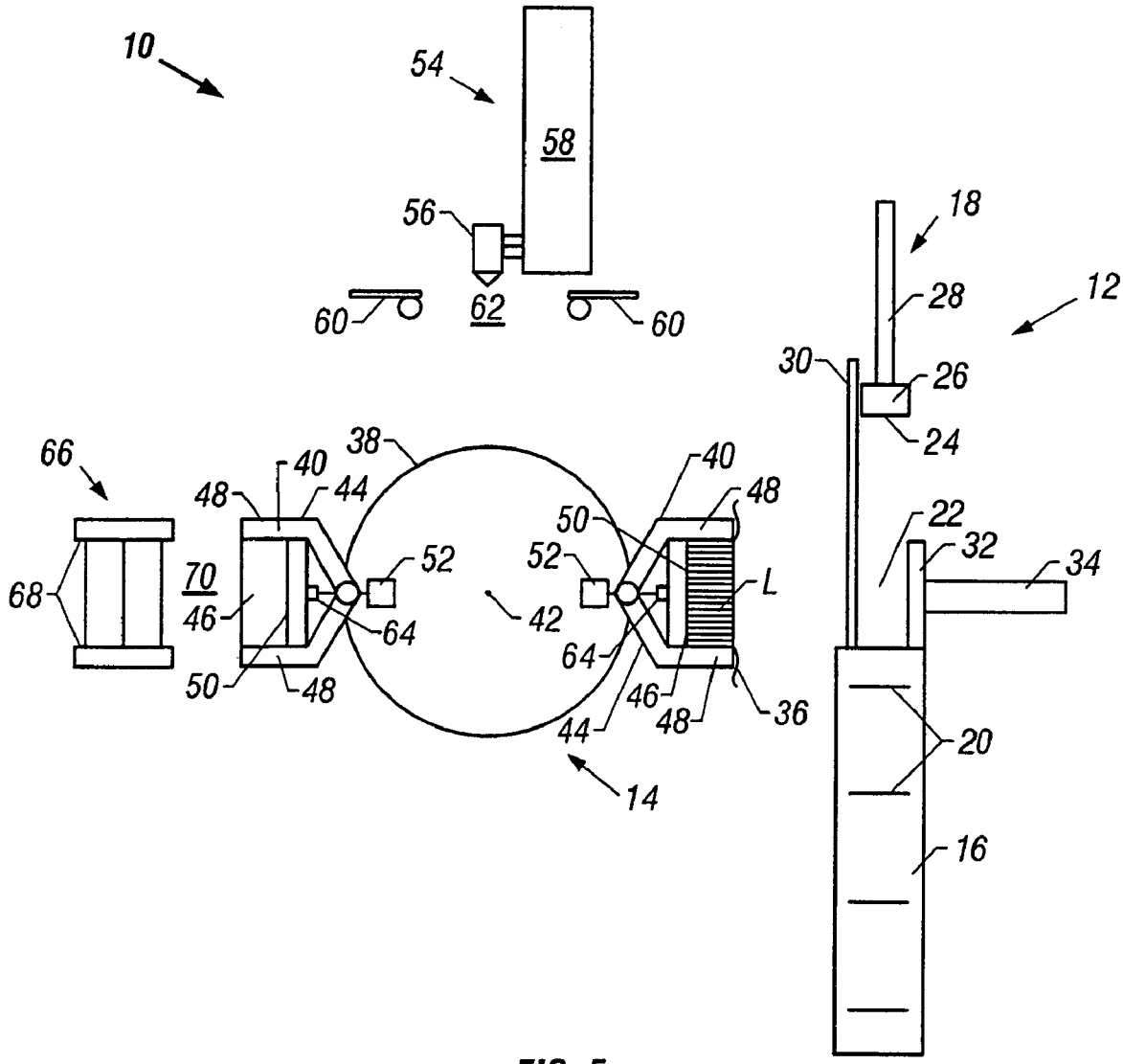

After pushing the log L and wrapping material 36 into the turret clamp 40 as just described, the piston 34 and wall 32 can be retracted to their original positions shown in FIGS. 1–4, and the turret clamp actuator 52 can retract the turret clamp 40 away from the log compression station 22 as shown in FIG. 5.

Figure 6:
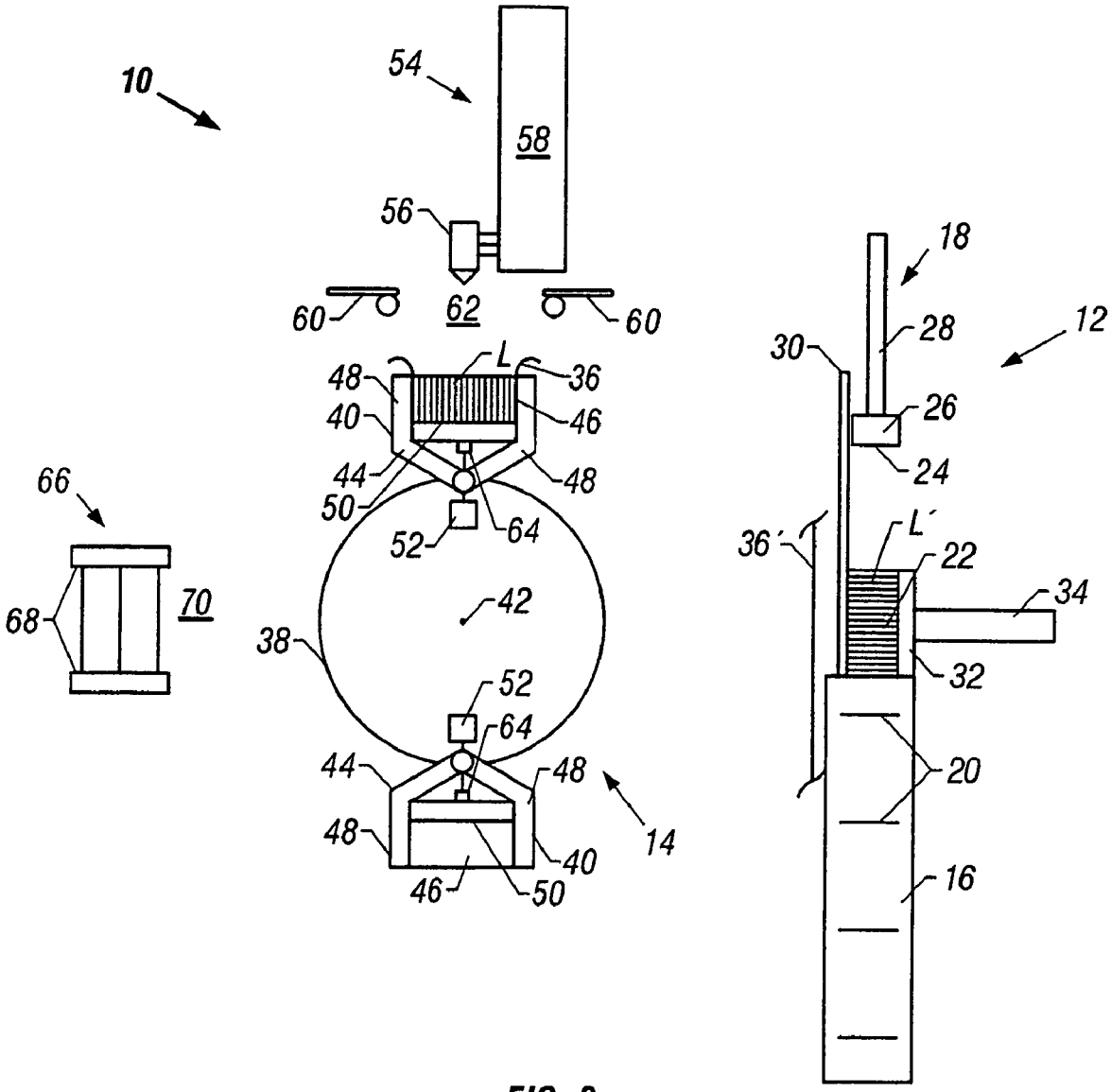
Figure 7:
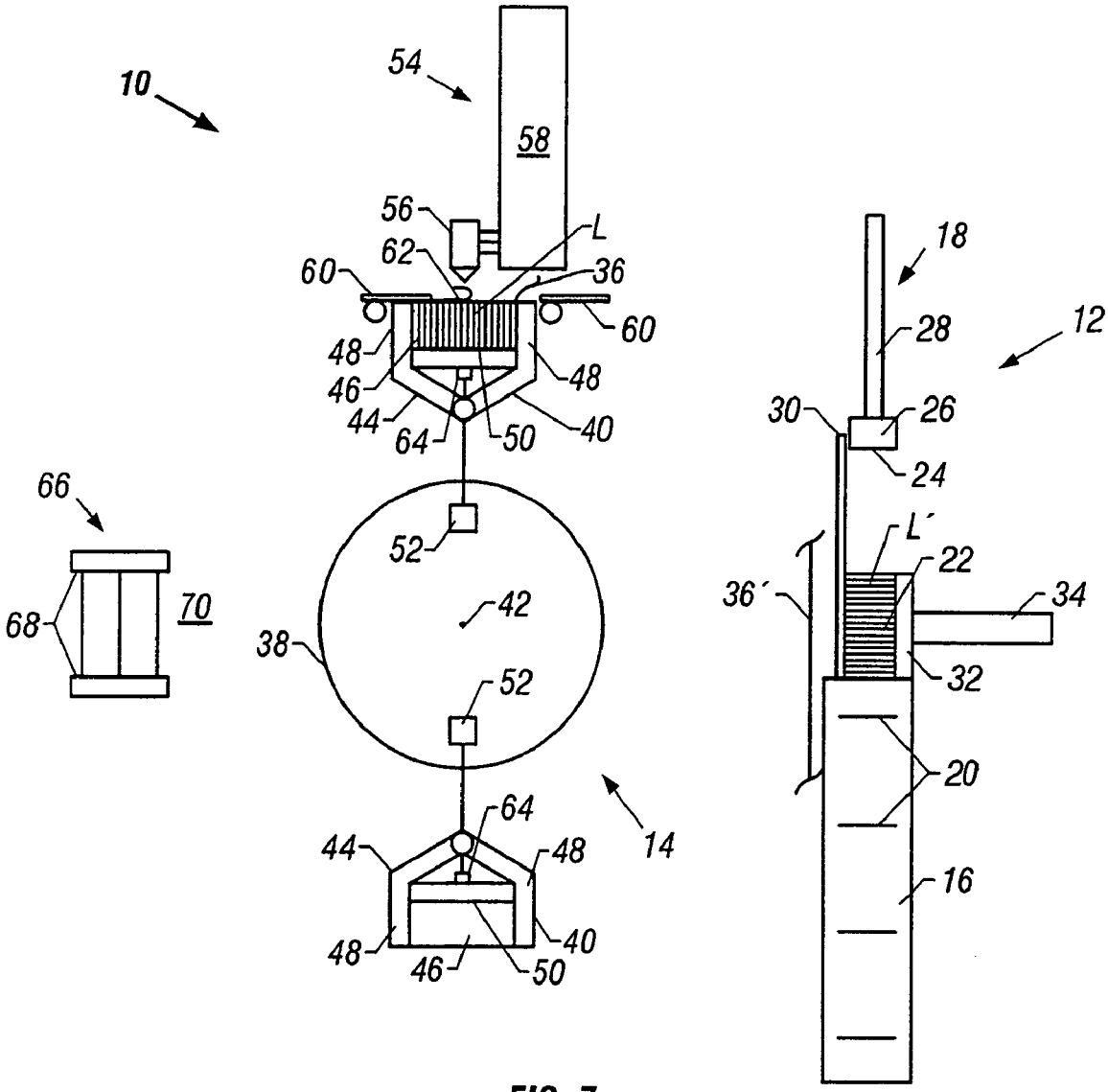
Figure 8:
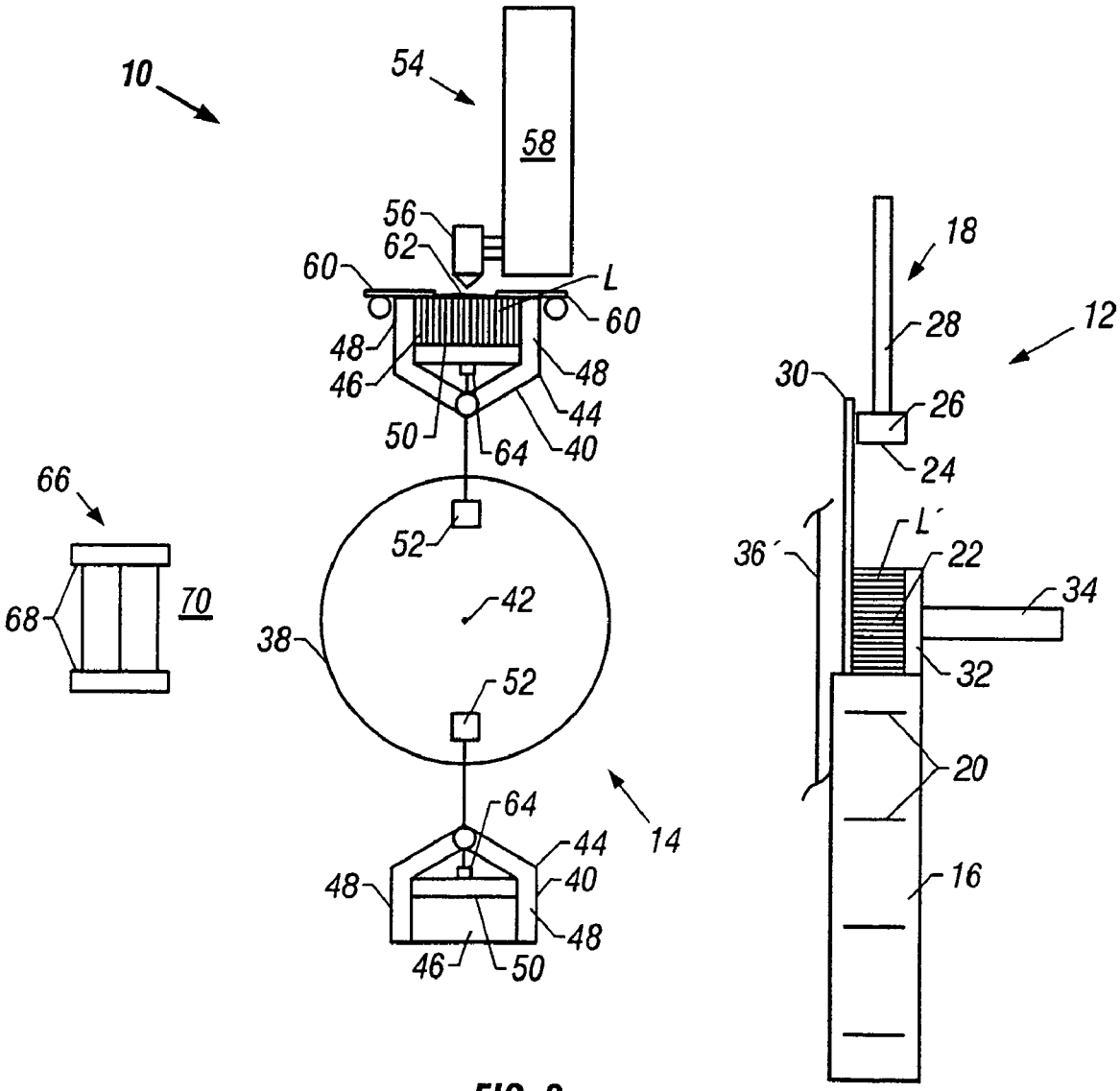

With the turret clamp 40 retracted, the wall 30 can now be moved back to its position beside the log compression station 22 in preparation for guiding and containing the next log L fed into the log compression station 22. Also, fresh wrap material 36' can also be fed into the log packaging apparatus 10 for the same purpose. With reference to FIG. 6, the turret 38 in the illustrated embodiment rotates to bring the log L and the turret clamp 40 into the wrap sealing station 62. The wrap material 36 in the illustrated embodiment of FIGS. 1–11 is wrapped about a majority of the log L in the turret clamp 40, with the unwrapped material unsecured to the log L as also shown in FIG. 6. To seal this unwrapped material about the still-compressed log L, the turret clamp actuator 52 can extends the turret clamp 40 and log L in the wrap sealing station 62 to the position shown in FIG. 7. One of the tuckers 60 flanking the turret clamp 40 in the wrap sealing station 62 is then extended as also shown in FIG. 7 to fold a portion or flap of the unwrapped wrap material over the log L. The adhesive applicator 56 can then apply an amount of adhesive (or other bonding material as described above) to the portion or flap folded by the tucker 60. A second tucker 60 can then be extended as shown in FIG. 8 to fold another portion or flap of the unwrapped wrap material over the log L and over the adhesive material applied by the adhesive applicator 56. In this manner, the wrap material 36 can be sealed about the log L in the turret clamp 40.

Figure 9:
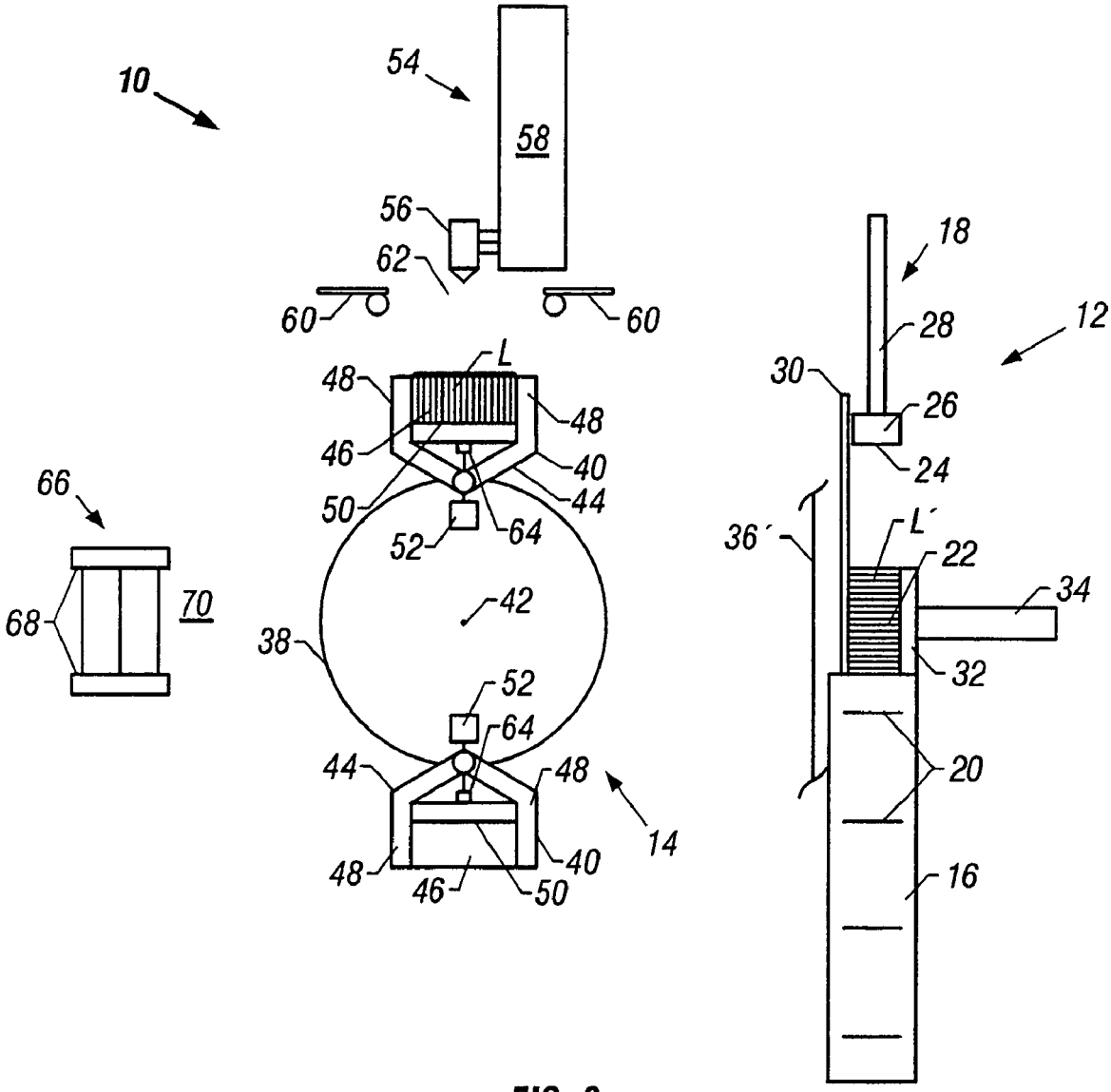
Figure 10:
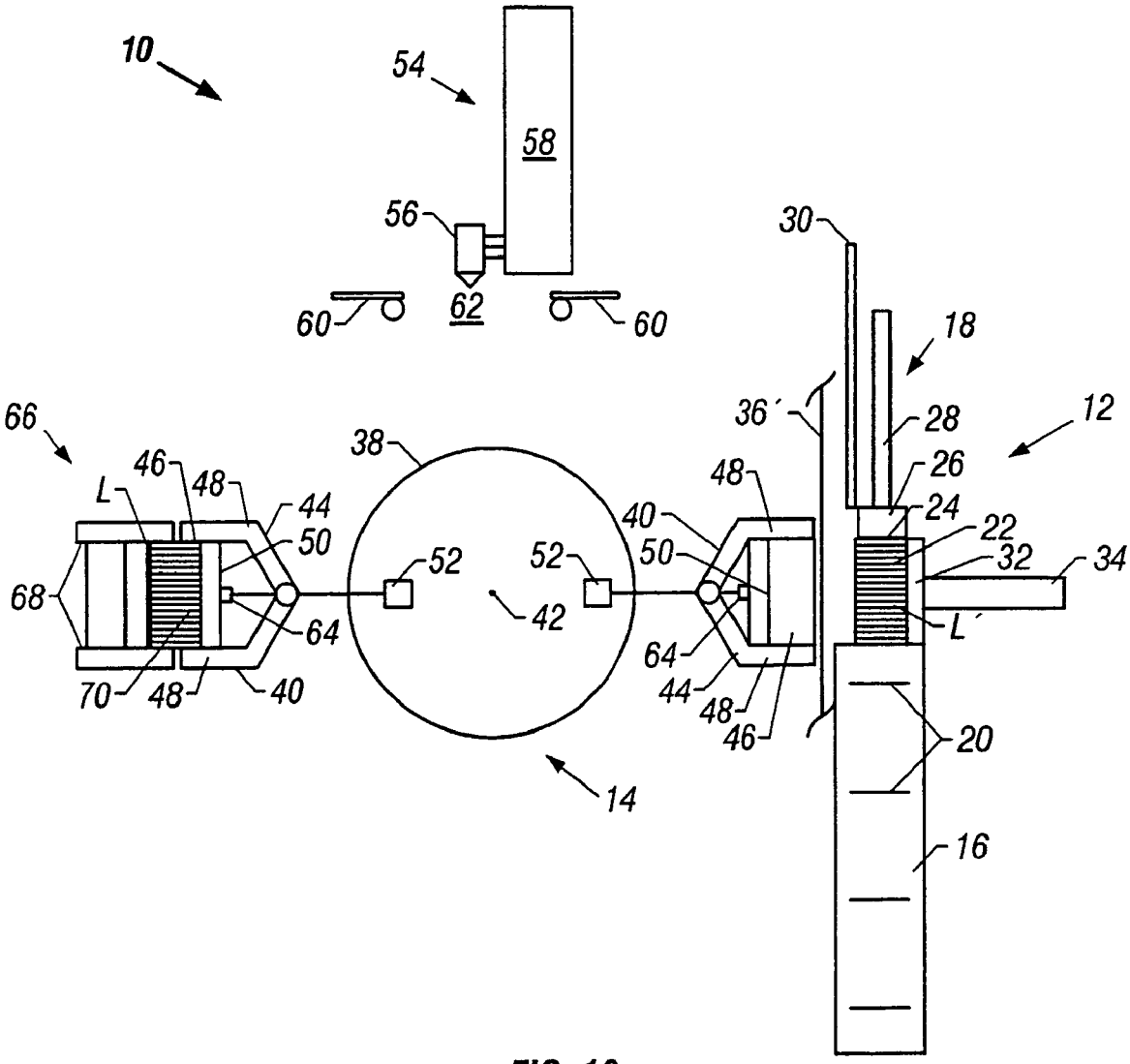
Figure 11:
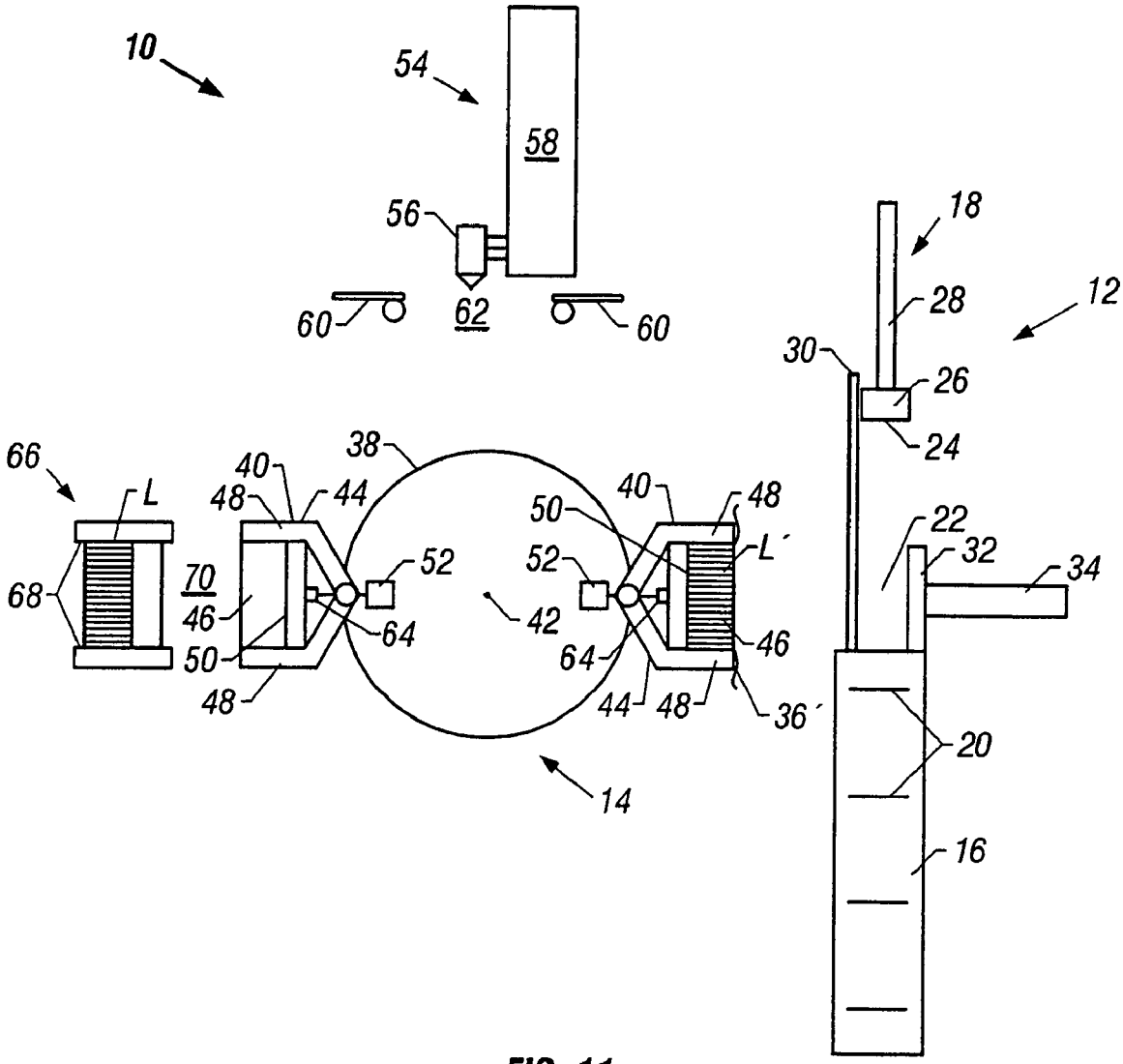

In the next step of log packaging apparatus operation, the turret clamp 40 can be retracted in the wrap sealing station 62 as shown in FIG. 9 in preparation for turret rotation. As shown in FIG. 10, the turret 38 can then be rotated until the turret clamp 40 and log L therein is positioned in a log discharge station 70. As with the ejection of logs L from the log compression station 22, the log L in some embodiments is not significantly decompressed by being ejected from the turret clamp 40. Therefore, the width between conveyor assemblies 68 in the log discharge system 66 can be the same or slightly larger (e.g., 0.125 in. larger) than the width of the log L in the turret clamp 40. Also, the distance between the turret clamp 40 and the log discharge system 66 (and more specifically, between the plates 48 of the turret clamp 40 and the log discharge system 66) is as small as possible in some embodiments. The turret clamp 40 can therefore be extended in the log discharge station 70 to a position immediately adjacent to the log discharge system 66 for log discharge.

After or during extension of the turret clamp 40 to the log discharge system 66, the back surface 50 of the turret clamp 40 can be moved by its actuator 64 to eject the log L from the log receptacle 46 of the turret clamp 40 (see FIG. 10). By the time the log L begins to exit the turret clamp 40, the turret clamp 40 can be located immediately adjacent the log discharge system 66 so that the compressed log L is smoothly transferred to the log discharge system 66. The log discharge system 66 can then transport the compressed log L to downstream operations. After the log L has been ejected from the turret clamp 40, the turret clamp 40 can be retracted by its actuator 52 to the position shown in FIG. 11 and can then be rotated by the turret 38 to the position shown in FIG. 2 for receiving another log L' in another cycle of log packaging apparatus operation.

Like the turret clamps 40, the log discharge system 66 can be at least manually adjustable to accommodate logs L of different sizes and to exert different compressive forces upon logs L therein. For example, and with reference to the embodiment of the present invention illustrated in FIGS. 1–11, numerous systems and devices exist for moving one or both conveyor assemblies 68 of the log discharge system 66 toward and away from one another. These systems and devices can be manually operated or can operate automatically upon receiving width information about the logs L being processed (e.g., either by direct measurement signals received from one or more sensors or conventional measurement devices on the turret clamps 40, log width information received from one or more sensors or conventional measurement devices on the log compression station 22, and the like). Such systems and devices and their manner of connection and operation are well known to those skilled in the art and are therefore not described further herein.

It should be noted that log packaging apparatus operation can be affected by the type of bonding material used as described above. For example, if tape is used to bond flaps of wrap material together in the wrap sealing station 62, later operations can be performed at any desired apparatus speed. However, where liquid adhesive is instead used, a setting time may be needed before the bond is exposed to significant stresses. As mentioned above, the logs L packaged in the apparatus of the present invention can be compressed prior to being wrapped. Therefore, it is desirable to maintain log compression in packaging operations downstream of the wrap sealing station 62 for sufficient time to allow certain bonding materials to set. This can be achieved in a number of different ways, such as by pausing the turret clamp 40 at the wrap sealing station 62 for a time sufficient to allow such bonding material to set, slowing the speed at which the above-described steps following adhesive application are performed, maintaining compression in the log discharge system 66 for sufficient time to set the bonding material, or a combination of such operations. In this regard, if the wrap material 36 does not require setting or has already been set by the time the log L reaches the log discharge station 70, the log discharge system 66 need not be of a type maintaining compressive force upon logs L received from the turret clamp 40.

The log packaging apparatus operations above have been described with reference only to one turret clamp 40. However, some embodiments of the present invention have multiple turret clamps 40 permitting multiple logs L to be wrapped in the log packaging apparatus 10 at once, thereby significantly increasing the output of packaged logs L with respect to a one-turret system and with respect to prior art packaging devices. Multiple logs L in the apparatus can therefore be in different stages of wrapping at any given time. In the exemplary embodiment illustrated in FIGS. 1–11, the turret 38 includes two turret clamps 40 on opposite sides of the turret 38. Therefore, after the turret clamp 40 and the log compressor 18 have been retracted in the step illustrated in FIG. 5, the log packaging apparatus 10 is ready to receive another log L' in the log compression station 22 (see FIG. 6). At any time thereafter, compression operations upon the log L' can take place (i.e., while the first log L is in the wrap sealing station 62 and/or when the first log L is being discharged to the log discharge system 66). Likewise, while the first log L is being discharged to the log discharge system 66, the next log L' can be ejected from the log compression station 22 to the second turret clamp 40 as shown in FIG. 10.

It will be appreciated that three, four, or even more turret clamps 40 can be mounted upon the turret 38 to receive and move multiple logs L in a similar manner. The relative positions of the log compressor 18, the wrap sealing system 54, and the log discharge system 66 can be determined by the relative positions and number of the turret clamps 40 upon the turret 38 so that an optimal number of turret clamps 40 are aligned with the most apparatus stations to enable operations to be performed simultaneously on different logs L. Still other embodiments of the present invention have more than one log compression system 12, wrap sealing system 54, and/or log discharge system 66 to further increase the number of logs L that can be wrapped simultaneously by the log packaging apparatus 10.

With reference to FIGS. 1–11, it can be seen that the various systems of the present invention can be spaced from one another about the turret 38 in a large number of arrangements. Unlike prior art log packaging devices which often locate two or more such systems close together while keeping the log stationary during many packaging operations, the spaced arrangement provided by the present invention permits much easier access to the various systems for quicker and more convenient manufacture, assembly, maintenance, repair, and jam removal. The flexibility of system location as described above is another advantage that does not exist in conventional log packaging devices.

FIGS. 12–15 illustrate a second embodiment of the present invention in which the log packaging apparatus 110 includes a compression station 102, a shuttle 104, and a wrap conveyor 106 which cooperate to wrap a log L in a sheet of wrap material 108. By way of illustration only, the following description and accompanying figures show packaging operations in which the log L is wrapped in a sleeve wrapper. In other embodiments of the present invention, the apparatus 110 can package, bind, wrap, seal, tie, and perform other packaging operations as described in greater detail above with respect to the first illustrated embodiment. Additionally, the following description describes a packaging process which utilizes a single sheet of wrapping material 108. However, other embodiments of the present invention can use more than one sheet of wrap material 108, strips of wrap material, straps of wrap material, etc. (as also described above).

The embodiment of the present invention illustrated in FIGS. 12–15 is similar in many respects to the embodiment described above and illustrated in FIGS. 1–11. In addition, the alternative structures and features described above with reference to the log packaging apparatus 10 in the first illustrated embodiment apply equally to the second illustrated embodiment described in greater detail below. Accordingly, the following description and accompanying figures incorporate the previously described embodiment, including the alternative embodiments described above.

Also, as with the previous illustrated embodiment, numerous operations can be performed upstream from the log packaging apparatus 110, including, sorting, rolling, stacking, folding, interfolding, and trimming operations not described herein.

With reference to the exemplary embodiment of FIGS. 12–15, a first log conveyor 113 (see FIG. 15) brings logs L from upstream web manufacturing operations. FIGS. 12–15 show an embodiment of the present invention in which the first log conveyor 113 includes a belt 115 driven in a conventional manner (e.g., about pulleys 117, sprockets, drums, shafts, axles, rollers, or other driven rotating elements). In the illustrated embodiment, any of the pulleys 117 can be driven to drive the belt 115. The belt 115 is driven to feed logs L to a position in the log compression station 102, such as axially along a path 112 represented by an arrow in FIG. 15.

In other embodiments, logs L are conveyed into the log compressor 118 from other feed directions with respect to the log compressor 118. By way of example only, logs L can enter the log compressor 118 laterally (with reference to FIGS. 12–14), such as through an opening or gap in a side of the log compressor 118. In such cases, the logs L can be rolled or pushed into the log compressor 118 or can be conveyed into the log compressor 118 in any of the manners described above. In such cases, one or more additional log conveyors can be employed as necessary to move the logs L into the log compressor 118 from the first log conveyor 113, such as a pusher plate coupled to an actuator.

Regardless of the direction in which logs L move into the log compression station 102, a number of alternative conveying devices and elements can be employed (including those discussed above). By way of example only, friction reducing rollers, chutes or slides, tabletop conveyors, bucket conveyors, and the like can also or alternatively be used to transfer logs L from upstream operations to the compression station 102. Such other material handling apparatuses and devices and their manner of connection and operation are well known to those skilled in the art and fall within the spirit and scope of the present invention.

The log compressor 118 can take any of the forms described above with reference to the first illustrated embodiment. In the exemplary embodiment illustrated in FIGS. 12–15, the log compressor 118 includes a compression chamber 143, a pressure surface 138, and an actuator 142 for moving the pressure surface 138 within the compression chamber 143. In some embodiments, the compression actuator 142 is a hydraulically actuated piston. In alternative embodiments, the compression actuator 143 can be any one of a variety of actuators, including for example, pneumatic or hydraulic actuators, a motor driving a ball screw, cams, or jack device, a solenoid, and the like. When a log L enters the compression chamber 143, the actuator 142 depresses the pressure surface 138, thereby compressing the log L. Once the log L is compressed, the compression actuator 143 can withdraw the pressure surface 138 so that the log L can be withdrawn from the compression station 102.

The compression chamber 143 in the illustrated exemplary embodiment of FIGS. 12–15 includes an opening 105 through which a log L in the log compressor 118 can exit the compression station 102. The opening 105 can be defined by a wall of the compression chamber 143, which can be stationary or can move to create the opening 105 (such as in any of the manners described above for moving the first wall 30 in the first illustrated embodiment). In the illustrated embodiment of FIGS. 12–15, a wall of the chamber 143 can be movable to at least partially enclose the compression chamber 143 when a log L is in the compression chamber 143. Once the log L is compressed, the wall of the compression chamber 143 can open to allow the log L to be ejected from the log compressor 118.

Figure 12:
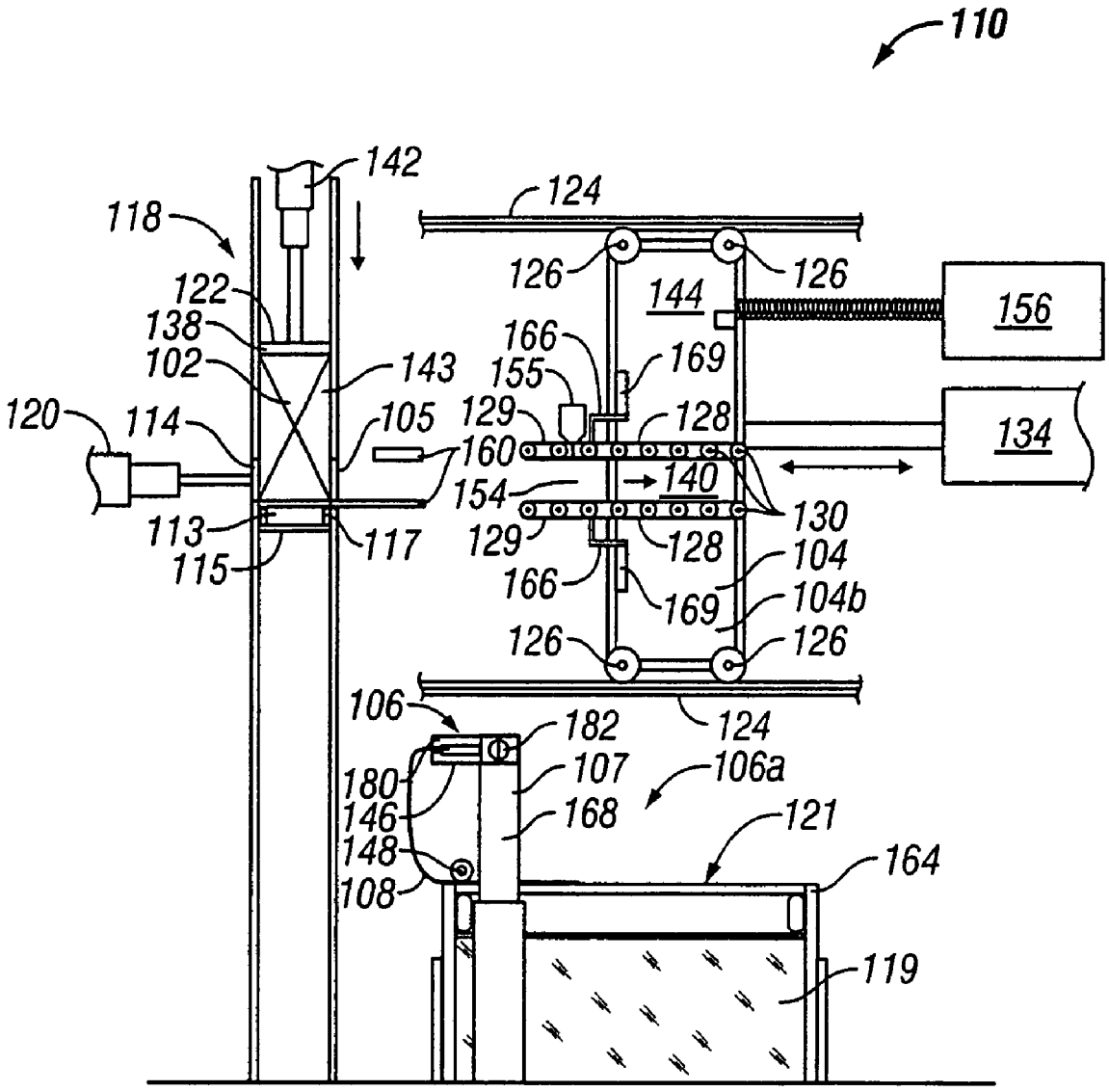
FIGS. 12–14 are elevational side views of the log packaging apparatus with a shuttle and wrap conveyor according to a second embodiment of the present invention.

With continued reference to the illustrated embodiment of FIGS. 12–15, the log packaging apparatus 110 employs an actuator 120 and pusher plate 114 for moving logs L from the log compressor 118. The pusher plate 114 can at least partially define a wall of the compression chamber 143 as shown in FIG. 12, and can take the form of a plate, a series of rods, a frame, an arm, and the like movable to push a log L from the compression chamber 143. In some embodiments, the pusher plate 114 and actuator 120 can also move to push or otherwise convey logs L into the log compressor 118, such as in those embodiments in which logs L are laterally received into the log compressor 1 8 as mentioned above. In such cases, the pusher plate 114 can be moved to define an opening in the compression chamber 143 (e.g., opposite the opening 105) to permit logs L to enter the compression chamber 143.

The actuator 120 can be a hydraulic piston, but can take any of the forms described above with respect to the first illustrated embodiment to push and pull pusher plate 114, including but not limited to motors (e.g., a stepper motor or other conventional motor driving one or more cams, screws, and other elements capable of moving the pusher plate 114), a pneumatic or hydraulic piston, a solenoid, and the like.

Although logs can be moved from the log compressor 118 (and in some cases into the log compressor 118 as described above) by an actuator 120 and pusher plate 114, in alternative embodiments logs L can be moved in this manner by any other type of conveying device, such as by a conventional conveyor belt, a series of powered or unpowered rollers, a gate, a series of fingers moveable at least partially through the log compression station 102, or any of the structures or elements described above with reference to the wall 32 in the first illustrated embodiment.

As mentioned above, in some embodiments a single log conveyor (not shown) can bring logs L to the log packing apparatus 110 and can move the logs L through and out of the compression station 102. In addition, the same log conveyor moving logs L from the log compression station 102 can also move the logs L onto a shuttle (described below) to at least partially package the logs L.

The log compression station 102, including the various components and alternative embodiments thereof, have all been described above with reference to the first illustrated embodiment, and therefore will not be described in greater detail. All of these embodiments and configurations can be used with the second illustrated embodiment as desired.

With continued reference to the exemplary embodiment illustrated in FIGS. 12–15, the log packaging apparatus 110 can also include a shuttle 104 employed for at least partially packaging logs L in a wrapping material. The shuttle 104, an example of which is illustrated in FIGS. 12–15, can include a carriage 144 capable of moving one or more logs L. In some embodiments, the carriage 144 is a metal frame (e.g., steel or aluminum by way of example only, although other materials such as plastic, composites, and the like can instead be employed) movable toward and away from the log compression station 102. The carriage 144 can take any shape capable of retaining the product guides 128 (described below) and other shuttle components in place while still enabling stability and movement of the shuttle as also described below.

The shuttle 104 is movable from a first position 104*a* (shown in FIG. 14) adjacent to the compression station 102 to a second position 104*b* (shown in FIGS. 12 and 13) spaced a distance away from the shuttle first position 104*a*. The shuttle 104 can move between the shuttle first position 104*a* and the shuttle second position 104*b* at times based at least partially upon the introduction of a sheet of wrap material 108 between the compression station 102 and the shuttle 104. In this regard, the motion of the shuttle 104 can be controlled by a conventional controller 156 (also described in greater detail below) which can also coordinate the motion of one or more of the other elements in the log packaging apparatus 110.

The shuttle 104 can move from the shuttle first position 104*a* to the shuttle second position 104*b* along one or more tracks 124. In different embodiments, the track 124 can be any track, rail, or brace suitable for moving or guiding machinery and equipment, including without limitation I-beams, tubes, shafts, bar stock, rails, and the like having any cross-sectional shape. The tracks 124 can be mounted on a shop floor and/or hung from a shop ceiling or frame, and can have sufficient strength to support the weight of the shuttle 104 and the weight of at least one log L. In some embodiments of the present invention (such as that shown in FIGS. 12–15), the shuttle 104 is movable along two or more tracks 124. In these embodiments, the weight of the carriage 144 and the log L can be more evenly distributed between the tracks 124.

The shuttle 104 can be moved along the track 124 by a shuttle actuator 134, which in some embodiments is one or more hydraulic pistons directly or indirectly connected to the shuttle 104. In other embodiments, the shuttle actuator 134 can be a motor operable to move the shuttle by one or more driving elements such as chains, belts, cables, or other elements connected to the motor. In other embodiments, the shuttle actuator 134 can be or include one or more pneumatic pistons, solenoids, and the like.

In still other embodiments of the present invention (not shown), the shuttle 104 can move or be moved by a rack and pinion assembly. For example, one or more conventional racks can be coupled to the shuttle 104, with one or more pinions mounted to an adjacent frame or other location(s) external to the shuttle 104 (or vice-versa). The pinions can be powered by any prime mover, including for example electric or hydraulic motors, and the like. The pinions can rotate, moving the shuttle 104 back and forth between the shuttle first position 104*a* and the shuttle second position 104*b*.

Alternatively, the shuttle 104 can be moved by one or more screws driven by motors or other conventional driving equipment. In such embodiments, one or more threaded shafts can be coupled to an adjacent frame or other location(s) external to the shuttle 104. The shuttle 104 can by driven along such threaded shafts in a conventional manner (e.g., by turning the screws and/or by rotating collars, worms, or other elements riding along the screws).

In still other embodiments, the shuttle 104 can be mounted about a pivot point for swinging motion to and from a position adjacent the log compression station 102, in which cases the movement of the shuttle 104 can be arcuate rather than linear.

The shuttle 144 is movable along the tracks 124 in any manner desired, such as by bearings on the shuttle 144 and/or tracks 124 and upon which the shuttle 144 rides, low-friction glides attached to the shuttle 144 and/or tracks 124, and the like. In the illustrated embodiment of FIGS. 12–15, rollers 126 are spaced around the carriage 144 to support the shuttle 144 as the shuttle 144 is moved along the tracks 124. In different embodiments it may be desirable to use more or fewer rollers 126 than illustrated. Although a shuttle actuator 144 can be employed to move the shuttle 144 as described above, in some embodiments one or more of the rollers 126 can be driven by a motor or in any other conventional manner to move the shuttle 104 along the shuttle track 126.

Some embodiments of the present invention employ product guides 128 in which logs L are received to at least partially wrap the logs L in wrapping material. An example of such product guides used in conjunction with a shuttle 144 is illustrated in FIGS. 12–15. The shuttle 104 in FIGS. 12–15 includes first and second product guides 128 positioned to receive logs L from the log compression station 102. In this regard, the product guides 128 can extend from the shuttle 104 toward the compression station 102 to receive logs L from the compression station 102. In this manner, the entire shuttle 104 need not necessarily approach to a position immediately adjacent the log compression station 102 in order to receive logs L therefrom.

In some embodiments, the product guides (e.g., first and second product guides 128 in the illustrated exemplary embodiment of FIGS. 12–15) are movable to pull logs L from the log compression station 102. In this regard, the product guide(s) 128 can be any type of product conveyor. In those embodiments in which multiple product guides 128 are employed, such product guides 128 can cooperate to pull the logs L from the log compression station 102, such as by their location with respect to logs L exiting the log compression station 102.

For example, the shuttle 104 in the illustrated embodiment of FIGS. 12–15 employs first and second product guides 128 spaced apart to define a log path 140 therebetween along which logs L are moved as the logs L pass through the shuttle 104. The distance between the first and second product guides 128 can therefore be determined at least in part by the size of compressed logs L exiting the log compression station 102. In some embodiments, the first and second product guides 128 are located relatively close to one another and are substantially parallel to one another to prevent compressed logs L from expanding. Therefore, the distance between the first and second product guides 128 can be preset for the desired size of packaged logs L. In some embodiments, the distance between the first and second product guides 128 can be adjustable so that a single log packaging apparatus 110 can be used to package logs L of different sizes. Such adjustment can be performed in a number of conventional manners, such as by mounting either or both product guides 128 to a frame whose position can be adjusted (e.g., via hydraulic or pneumatic cylinders connected thereto, by one or more cranks connected thereto, by moving and securing the frame to one of multiple attachment locations on a frame of the apparatus 110, and the like).

In the illustrated embodiment of FIGS. 12–15, the first and second product guides 128 are belts 129 extending about pulleys 130. The first and second product guides 128 and their respective belts 129 and pulleys 130 in the illustrated embodiment are substantially similar to one another.

The pulleys 130 are one of several different rotating elements about which the belts 129 can be moved to move logs L in the shuttle 144. Accordingly, although pulleys 130 are described herein, any other conventional element employed to drive a belt or other similar conveyor can instead be employed, including without limitation sprockets, drums, axles, bars, shafts, rollers, drums, tubes, and the like.

In some embodiments, rotation of any one or more of the pulleys 130 moves each belt 129 along the log path 140. Any one or more of the pulleys 130 can be driven in any conventional manner, such as by direct or indirect connection to a motor (not shown) mounted on the shuttle 144, by one or more belts, chains, cables, gears, and other power transmission elements connected to the rollers 126 to drive the pulleys 130 when the rollers 126 rotate, or in any other conventional manner.

Although conveyor belts 129 are employed to receive and move logs L in the shuttle 144, it will be appreciated that other product conveying devices and elements can be employed to perform the same function. For example, one or both of the product guides 128 can be powered or unpowered rollers, pusher plates, tabletop conveyors, paddle conveyors, and the like. In such embodiments, the product guides 128 can move or can assist in moving the logs L from the compression station 102 into and through the shuttle 104 while keeping the logs L compressed. The product guides 128 can be driven in any of the manners described above with reference to the belt-type conveyors 129 illustrated in FIGS. 12–15.

In addition to or rather than employing product guides 128 that are movable to move logs L in the shuttle 144, the shuttle 144 can have one or more stationary product guides 128 that are positioned to receive logs L and to at least partially wrap material thereabout. Such product guides 128 can take the form of plates, rods, rails, skis, or other elements that are stationary with respect to the shuttle 144 but which are positioned to at least partially wrap material about a log L as the log enters the shuttle or moves in the shuttle.

Although two product guides 128 are employed in the illustrated embodiment of FIGS. 12–15, any number of stationary or movable product guides 128 can be used in other embodiments of the present invention, depending at least in part upon the type of material being packaged, and/or the size and shape of logs L being packaged. For example, in some embodiments a single product guide 128 can be coupled to the shuttle 104. Similarly, three, four, or any other number of product guides 128 can be coupled to the shuttle 104. In still other embodiments, the product guides 128 rotate the logs L about their own axes as the logs L are moved along the log path 140.

As shown in FIGS. 12–15, in some embodiments the log packing apparatus 110 can include one or more log guides 160 extending from the log compression station 102. When employed, the log guides 160 can extend from the compression station 102 toward the shuttle 104 in its position 104*b* adjacent the log compression station 102. In the illustrated embodiment, the log guides 160 are substantially parallel stationary plates which are spaced apart to maintain pressure on the logs L as the logs L are passed from the compression station 102 to the shuttle 104. In this manner, the logs L do not expand after leaving the compression station 102, although other log guide spacings are possible to permit an amount of desired expansion.

In alternative embodiments, other numbers and types of log guides 160 can be employed. By way of example only, the log guides can be rails, plates, bars, ramps, frames, and other elements suitable to guide logs L exiting the log compressor 118. In other embodiments, the log guides 160 are moveable members such as conventional conveyor belts, tabletop conveyors, powered or unpowered rollers, and the like, in which case the log guides 160 can be movable to move the logs L from the compression station 102 onto the shuttle 104.

With continued reference to the illustrated embodiment of FIGS. 12–15, the log packaging apparatus 110 includes a wrap material source 119 from which wrap material is fed to package logs L. In the illustrated embodiment, the wrap material source 118 is positioned relatively near the compression station 102 and shuttle 104. However, in alternative embodiments, the wrap material source 118 can be located any distance away from the compression station 102 and the shuttle 104. In some embodiments, a sheet feeding apparatus 164 (described in greater detail below) is employed to guide wrap material 108 from the wrap material source 118 toward the compression station 102 and the shuttle 104.

FIGS. 12–15 show an embodiment of the present invention in which the wrap material source 118 is a large roll of wrap material mounted to rotate around its own axis as sheets of wrap material 108 are drawn from the roll. In other embodiments, the wrap material source 118 can be a stack of folded or interfolded wrap material or wrap material found in any other form.

The wrap material source 118 can include a number of sheets of wrap material 108. The sheets of wrap material 108 can be a sleeve packaging material as described above. However, other types of packaging material can instead be used, such as plastic sheeting and other synthetic materials, woven and non-woven textiles and cloth, foil, paper products, nylon, etc. The sheets of wrap material 108 can be ready (in proper size) to be moved in place for wrapping operations, or can be perforated or cut at any point prior to or during such movement. For example, the wrap material 108 on the roll 118 in the illustrated embodiment can have perforation lines running across the wrap material so that each sheet can be separated from the rest of the material as needed (i.e., prior to being moved in place for wrapping, during movement into position for wrapping, etc.). As another example, the wrap material 108 can be cut by one or more blades, a laser, a cutoff roll or other cutting element (not shown) past which the wrap material 108 moves.

In some embodiments, the wrap material source 118 is located a distance from the log compression station 102. In such cases, the wrap material (whether in individual sheet form or prior to being cut or otherwise separated into individual sheet form) can be fed from the material source 118 to the compression station 102 by routing the wrap material 108 through and/or around any number of conventional feed mechanisms such as guides, rollers, positioning fingers and the like. Similarly, conventional feed mechanisms can be used as necessary to guide the sheets of wrap material 108 to a position adjacent the log compression station. In some cases, the wrap material 108 is moved to a wrap material staging location 121 in preparation of being moved to a wrapping position adjacent to the log compression station 102. Wrap material 108 can be moved to the staging location in any conventional manner. For example, in some embodiments at least a portion of the path taken by the wrap material 108 from the material source 118 to the staging location 121 is defined by a conveyor (such as a belt, tabletop, chain, or other type of conveyor). In the illustrated embodiment, a conventional vacuum-assisted belt conveyor is employed to move wrap material 108 to the wrap material staging location 121. A vacuum-assisted belt can be employed to hold the wrap material 108 with sufficient strength while being drawn to the staging location 121. Of course, other types of conveying devices and assemblies can be employed for this purpose. By way of example only, the wrap material 108 can be received and drawn between and by two facing belt conveyors. In some embodiments, the feeding conveyor 164 can include one or more other types of conveyors, such as driven or non-driven rolls, ramps, and the like.

To move wrap material 108 from the staging location 121 to a wrapping position adjacent the log compression station 102, the log packaging apparatus 110 of the present invention can include a wrap conveyor 106. The wrap conveyor 106 is moveable between a wrap conveyor first position 106*a* at the staging location 121 (e.g., adjacent to the tabletop vacuum conveyor 164 in the illustrated embodiment of FIGS. 12–15 and a wrap conveyor second position 106*b* between the compression station 102 and the shuttle 104. In some embodiments, when the wrap conveyor 106 is in the wrap conveyor second position 106*b*, the wrap conveyor 106 is positioned above, below, or to either or both sides of the shuttle first position 104*a* rather than being positioned between the shuttle first and second positions 104*a*, 104*b*. In this manner, the shuttle 104 can be moved into the shuttle first position 104*a* when the wrap conveyor 106 is in the wrap conveyor second position 106*b* without contacting or interfering with the shuttle 104.

The wrap conveyor 106 can take a number of different forms, each one of which is capable of moving a sheet of wrap material 108 from the wrap material staging area 121 to a position between the log compression station 102 and the shuttle 104. In the illustrated embodiment of FIGS. 12–15 for example, one or more vacuum-assisted suction heads 180 are movable between these positions. The vacuum heads 180 can be connected to a beam extending along the length of the sheet of wrap material (i.e., into the plane of the page in FIGS. 12–14), can be defined by a tube or other element having a vacuum line running therealong to distribute suction along the length thereof, can be one or more suction cups, can be one or more fingers capable of grabbing or pinching the sheet of wrap material 108 at the staging area 121, or can be any other device suitable to grasp the sheet material 108 in preparation of moving the sheet material 108.

In order to move the sheet of wrap material 108 from the wrap material staging area 121, the vacuum heads 180 in the illustrated embodiment of FIGS. 12–15 are movable vertically. In this embodiment, the vacuum heads 180 are attached to a beam 182, the ends of which ride within one or more tracks or rails (not shown) on either side of the sheet of wrap material 108. The beam 182 can be moved to different positions (different vertical positions in the illustrated embodiment of FIGS. 12–15) in a number of different manners, such as by one or more actuators 168. In the illustrated embodiment of FIGS. 12–15, the actuators 168 are hydraulic or pneumatic cylinders 168. In this embodiment, the beam 182 is directly or indirectly connected to the hydraulic or pneumatic cylinders 168, which can be located beside the sheet of wrap material 108 and actuatable to lift and lower the beam and/or can be connected to telescoping shafts 107 that can be extended and retracted to vertically move and position the beam 182. In other embodiments, the beam 182 can be vertically driven and positioned by cables, chains, or belts attached thereto and passing about upper and lower pulleys, sprockets, drums, axles, or other rotating elements, any of which can be driven by a motor or other conventional driving device. Alternately, the beam 182 can be vertically driven and positioned by vertically-oriented rotatable screws located on opposite sides of the sheet of wrap material 108, wherein the screws are driven by a motor or other conventional driving device to lift and lower the beam 182 therein in a conventional manner. In other embodiments, the beam 182 can be connected to a vertically-oriented rack and pinion assembly on either or both sides of the sheet of wrap material 108, whereby one or more motors can drive pinions on the sides of the sheet 108 in order to lift and lower racks secured to the beam 182. Still other conventional devices and elements can be employed to lift and lower the beam 182 to which the vacuum head(s) are attached (or are defined by), all of which fall within the spirit and scope of the present invention.

As an alternative to the use of a beam 182 spanning a distance between the sides of the sheet of wrap material 108 discussed above, the vacuum head(s) 180 (or other sheet gripping elements or devices described herein) can be vertically movable in other manners for moving the sheet of wrap material 108 into place between the log compression station 102 and the shuttle 104. For example, a vacuum head 180 can be located at each end of the sheet of wrap material, and can be vertically movable in any of the manners described above with reference to vertical movement of the beam 182.

In other embodiments, sheets of wrap material 108 are moved vertically by suction cups, pinching or grabbing fingers, one or more tacky or wet contact surfaces (e.g., having an adhesive material or water thereon), electrostatically-charged members, one or more picks which pierce the web material 108 to draw and move the web material 108, or other elements that can hold and move the wrap material 108. Such elements in these embodiments can also be arranged and vertically movable in any of the manners described above with respect to the use of vacuum heads 180 performing the same function. In still other embodiments, the sheets of wrap material 108 can be moved by one or more rolls, belts, or other sheet conveying elements and assemblies on either or both sides of the sheets of wrap material 108. For example, the ends of the sheets of wrap material 108 can be trapped between sets of rolls or sets of belts on either side of the sheets of wrap material 108, can be drawn by one or more vacuum-assisted rolls or belts on either side of the sheets of wrap material 108, and the like. In each case, the sheets of wrap material 108 can be drawn from the staging location 121 described above to a position adjacent the log compression station 102 in preparation of wrapping operations.

In some embodiments of the present invention (such as the illustrated embodiment of FIGS. 12–15), the sheets of wrap material 108 are fed around one or more idler rollers 148 or other rotating or non-rotating sheet guides as the sheets are moved from the staging area 121 as described above. The idler roller(s) 148 can be employed to direct the sheets of wrap material 108 around obstructions in the log packaging apparatus 110 and/or to feed the sheets of wrap material 108 in a desired direction toward a position between the log compression station 102 and the shuttle 104. In various embodiments, the idler rollers 148 can have a number of shapes and configurations, and can be pulleys, drums, axles, shafts, bars, and the like, any of which can be rotatable about their own axes. By way of example only, FIGS. 12–15 show an embodiment in which the idler roller 148 is adjacent the wrap conveyor 106 (described in detail below) to guide the sheets of wrap material 108 from the staging area 121 and/or the wrap material source 118 to a position between the shuttle 104 and the log compression station 102. In other embodiments, other conventional feed mechanisms can also or alternatively be used to control the movement of the sheets of wrap material 108 as they travel to a position between the log compression station 102 and the shuttle 104.

Some embodiments of the present invention employ vacuum heads 180 (or other sheet grasping elements and devices as described herein) that are rotatable with respect to the staging area 121 in order to direct sheets of wrap material 104 in a desired manner. For example, the vacuum heads 180 in the illustrated embodiment are pivotable about an axis of the beam 182 in order to help draw sheets of wrap material 108 away from the staging area 121.

In operation, the wrap conveyor 106, while in the wrap conveyor first position 106*a*, can grasp a sheet of wrap material 108 from the wrap material source 118, or alternatively from the sheet conveying apparatus 164. The wrap conveyor 106 then moves with the sheet of wrap material 108 to the wrap conveyor second position 106*b*. In some embodiments, once the wrap conveyor 106 is in the wrap conveyor second position 106*b*, the shuttle 104 moves into the shuttle first position 104*a*. In this manner, the sheet of wrap material 108 is positioned between the compression station 102 and the shuttle 104, or alternatively between the pusher plate 114 and the second log conveyor 114 (e.g., in those cases where the log L is not compressed). A log L is then passed from the log compression station 102 to the shuttle 104 or is otherwise moved toward the shuttle 104. As the log L is moved onto the shuttle 104, the log L contacts the sheet of wrap material 108 and drags the sheet of wrap material 108 onto the shuttle 104. The wrap conveyor 106 can then release the sheet of wrap material 108 as the log L drags the sheet of wrap material 108 onto the shuttle 104. For example, in those embodiments employing vacuum heads 180 to grasp the sheet of wrap material 108, vacuum can be cut off or reduced to the vacuum heads 180 in order to release the wrap material 108. As another example, in those embodiments employing fingers (e.g., opposable fingers) to grasp the sheet of wrap material 108, the fingers can be actuated to open in order to release the wrap material 108. Alternatively, the grasping force can be sufficient enough to move the sheet of wrap material 108, but low enough to permit the sheet of wrap material 108 to be drawn from the wrap conveyor 106 when the log L pushes the sheet of wrap material 108 into the shuttle 104.

After the log L and sheet of wrap material 108 have been received in the shuttle 104, the shuttle 104 can then move from the shuttle first position 104*a* to the shuttle second position 104*b*. Once the shuttle 104 has moved out of the shuttle first position 104*a*, the wrap conveyor 106 can move from the wrap conveyor second position 106*b* back to the wrap conveyor first position 106*a* to receive another sheet of wrap material 108.

Although the timing of element movements described above is employed in the illustrated embodiment of FIGS. 12–15, other movement timings are possible. For example, in some embodiments the shuttle 104 can move toward and/or away from the shuttle first position 104*a* as the wrap conveyor 106 moves between the wrap conveyor first and second position 106*a*, 106*b* (providing sufficient clearance exists between the wrap conveyor 106 and the shuttle 104 to avoid interference between these structures). Also, in some embodiments the wrap conveyor 106 can move toward and/or away from the wrap conveyor first and second positions 106*a*, 106*b* while the shuttle 104 is moving between the shuttle first and second positions 104*a*, 104*b*, and in some cases even while the shuttle 104 is in the shuttle second position 104*b* provided that sufficient clearance exists between the shuttle 104 and the wrap conveyor 106 when the shuttle 104 is in the shuttle first position 104*a*. As another example, the wrap conveyor 106 need not necessarily release the sheet of wrap material 108 as the log L drags the sheet of wrap material 108 onto the shuttle 104. Instead, the wrap conveyor 106 can release the sheet of wrap material 108 prior to or after the log L has been moved toward the shuttle 104, depending at least in part upon the orientation of the log packaging apparatus 110 and the position of the components thereof when the sheet of wrap material 108 is released.

As shown in FIGS. 12–15, in some embodiments the shuttle 104 includes at least one tucker 166 actuatable to move one or more portions of the web material 108 with respect to the log L to at least partially wrap the material 108 about the log L. Any number of tuckers 166 can be mounted in any suitable manner to the shuttle 104 (e.g., to the carriage 144) for movement in any direction with respect to the log L therein, thereby moving one or more portions of the wrap material 108 adjacent to the log L. In the illustrated embodiment of FIGS. 12–15 for example, two tuckers 166 are positioned on opposite sides of the log path 140, and are actuatable to move along a rear face of the log L in the shuttle 104. The tuckers 166 can take any conventional form, and in the illustrated embodiment are opposable fingers. In other embodiments, the tuckers 166 can be, for example, one or more fingers, a plate, and the like mounted in any conventional manner to move with respect to the log L in the shuttle 104.

As discussed above, as a log L and a sheet of wrap material 108 is moved onto the shuttle 104, the log L is at least partially wrapped in the sheet of wrap material 108. The tuckers 166 can move into and out of the log path 140 or otherwise can move with respect to the log L, contacting the sheet of wrap material 108 and forming the sheet of wrap material 108 around the log L. In some embodiments, the tuckers 166 contact trailing edges of the sheet of wrap material 108 and tuck them around the log L.

Any number of tuckers 166 can be positioned in any number of different locations along the log path 140. In alternate embodiments, other wrap positioning members can also or instead be used to better insure that the sheet of wrap material 108 is correctly positioned with respect to a log L. For example, in some embodiments one or more fluid jets (not shown) can be positioned along or near the log path 140. The fluid jets can force air or other fluid upon the sheet of wrap material 108, at least partially forming the sheet of wrap material 108 around the log L.

Figure 13:
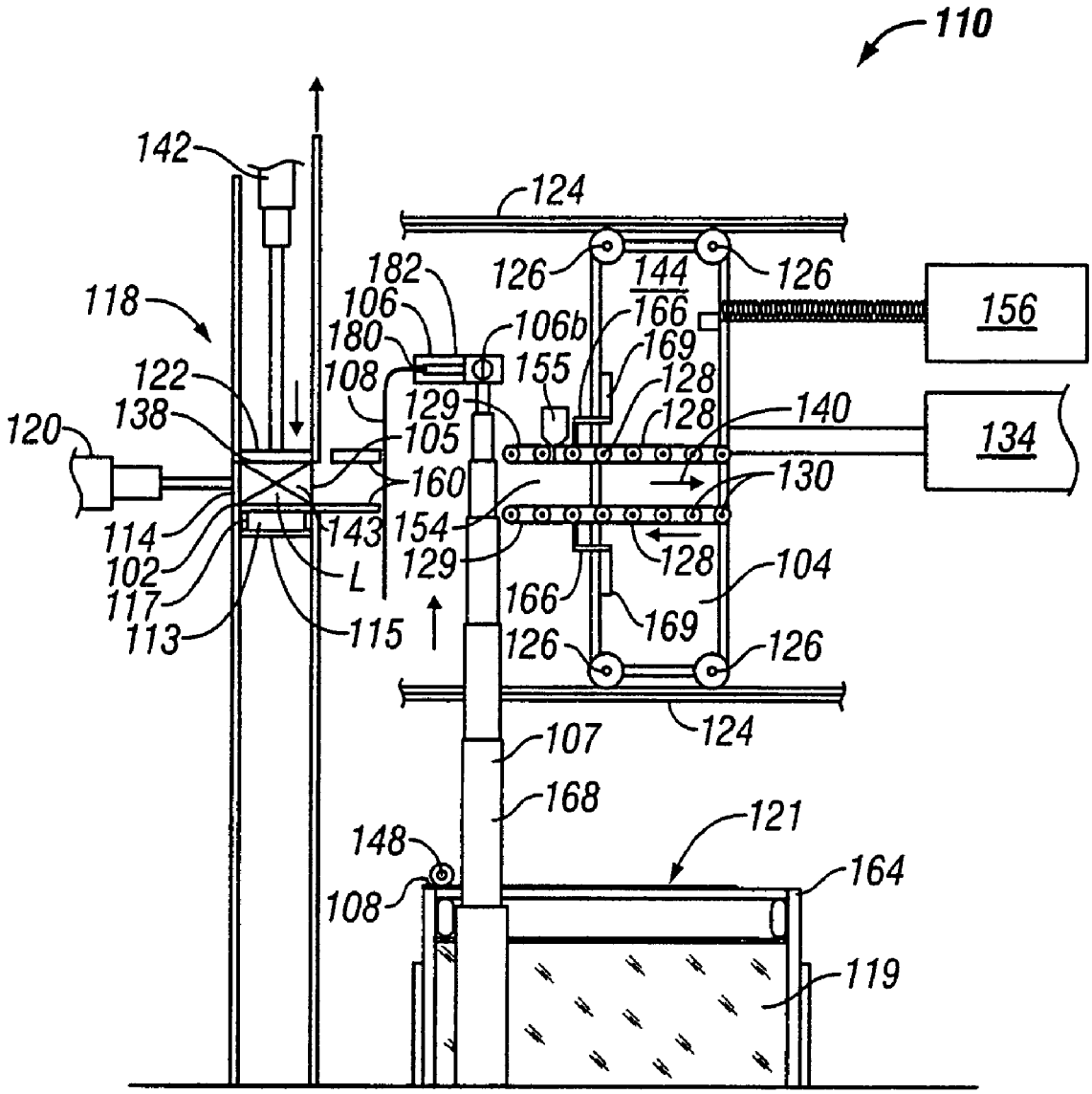
Figure 14:
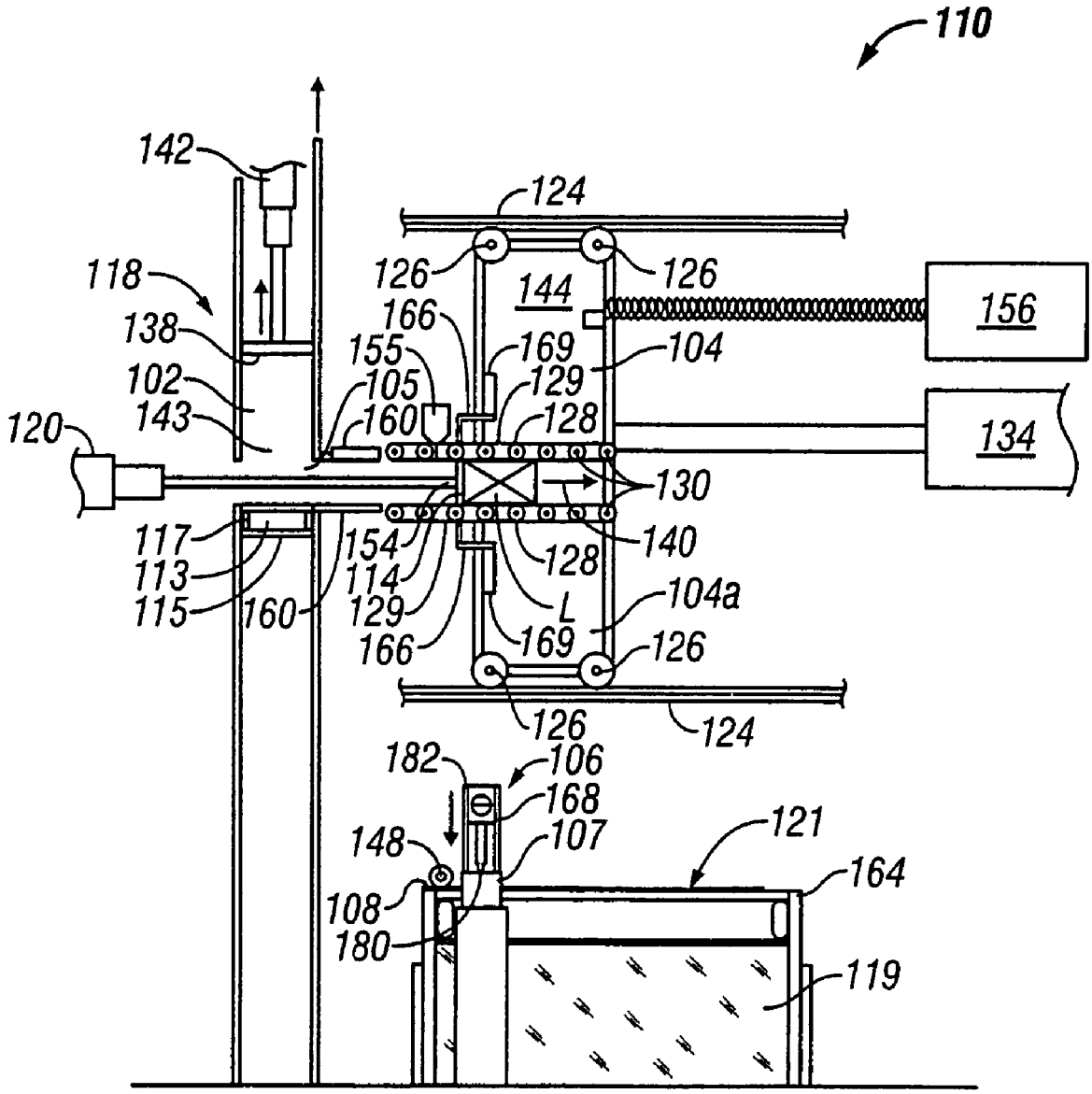
Figure 15:
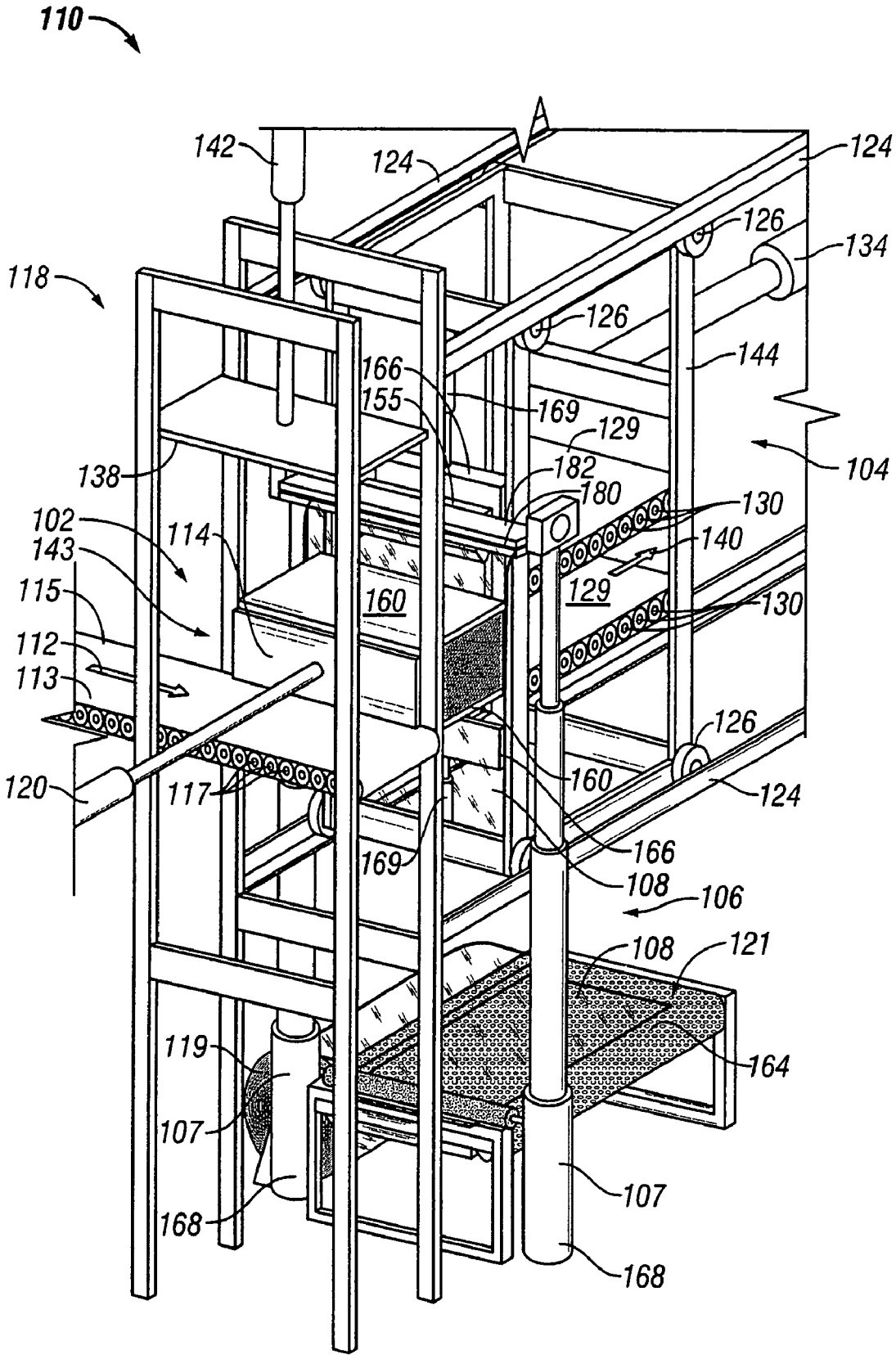
FIG. 15 is a perspective view of the log packaging apparatus illustrated in FIGS. 12–14.

The tuckers 166 can be driven by tucker actuators 169 (only one of which is shown in FIGS. 12–14). The tucker actuators 169 in the illustrated embodiment are hydraulic or pneumatic cylinders, but can be any other conventional driving device can instead be employed, including without limitation solenoids and motors (connected to the tuckers 166 by gears or in any other suitable manner).

Tucker, fold over, and fold down devices (such as fingers, plates, swing arms and like devices), their manner of connection, motion, and operation, and the devices which actuate them are well known to those skilled in the art and are not therefore described further herein. All such devices and their manner of connection, motion, actuation, and operation fall within the spirit and scope of the present invention. Additionally, the first and second tuckers 166 can be substantially similar to the tuckers 60 described in the first illustrated embodiment of the present invention.

As also shown in FIGS. 12–15, the shuttle 104 can include a wrap sealing station 154. The wrap sealing station 154 can be located anywhere with respect to the shuttle 104, and in some embodiments is located near the tuckers 166, such as an upstream location on the product guides 128. The wrap sealing station 154 can be an area through which the log L moves in the shuttle 104 or can be a particular location in the shuttle 104. In either case, the wrap sealing station 154 includes an adhesive applicator 155 for applying adhesive to the sheet of wrap material 108 and/or the log L for sealing the sheet of wrap material 108 around the log L. The wrap sealing station 154 (and its manner of operation and alternative embodiments) is substantially similar to the wrap sealing station 66 described above and therefore will not be described in greater detail herein.

Following wrapping operations upon a log L in the log packaging apparatus 110, the log L can exit the log packaging apparatus 110 in a number of different manners. In the illustrated embodiment of FIGS. 12–15 for example, the log L can be conveyed by the product guide(s) 128 to a position in which the log L can drop from, be conveyed away from, or can otherwise leave the shuttle 104. In some cases, the product guide(s) 128 convey the log L to a location on the shuttle 104 in which one or more conveyors can transport the packaged log L away from the log packaging apparatus 110, such as by employing any of the log discharge structures and any of the log discharge manners described above with reference to the first illustrated embodiment. In this regard, the product guides 128 can pause or decelerate the log L at the wrap sealing station 154 in order to permit the tuckers 166 and adhesive applicator 155 to at least partially wrap the log L, or can be driven to move the log L at a constant or varying speed through the shuttle 104 while the tuckers 166, adhesive applicator 155 and any other wrap manipulation elements and devices perform wrapping operations as discussed above. In those embodiments in which the product guides 128 do not convey the log L in the shuttle 104, the log L can be ejected from the shuttle 104 in any number of other manners, such as by being picked, pulled, grasped, or otherwise moved from its location in the shuttle 104 by another element or assembly (e.g., robotic arm, suction device, and the like), or by being dropped or guided out of the shuttle 104 (e.g., through or via a chute, opening, and the like). It should also be noted that logs L conveyed or otherwise moving though the shuttle 104 can exit the shuttle 104 (and the log packaging apparatus 110) in any direction desired, depending at least in part upon the orientation of the log packaging apparatus 110 and the type and arrangement of product guides 128 employed.

In some highly preferred embodiments of the present invention, a controller 156 coordinates the operation and movement of any one or more of the components of the log packaging apparatus 110, such as the compression station 102, the shuttle 104, the first log conveyor 113, the pusher plate 114, the wrap conveyor 106, the tuckers 166, the product guides 128, the wrap sealing station 154, the sheet conveying apparatus 164, and/or the beam 182 for non-interfering operation. The system controller 156 can take any form desired, such as a microcontroller-based system controller 156, a series of discrete logic elements and circuitry, and the like, and can be connected to and control the timing and/or speed of each of these elements in a manner well known to those skilled in the art. Additionally, one or more sensors (not shown), including motion sensors, proximity sensors, trip switches, and the like can be used with or without the controller 156 to coordinate the various elements of the log packaging apparatus 110. In these and other embodiments, one or more timers (not shown) can also or alternatively be used to coordinate the various elements of the log packaging apparatus 110. Controllers 156, sensors, and timers for machine control and operation are well known to those skilled in the art of machine design and are therefore not further described herein.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, and noted above, the present invention can be used to package product found in forms other than stacked form, such as rolled product (e.g., toilet paper, paper towels, etc.), bundled product (e.g., banded or unbanded stacks of newspaper, folded boxes, bags, etc.), or even fiber or particulate form (e.g., food product, wood chips, etc.). The shape and design of various portions of the log packaging apparatus 10 can therefore take forms better suited for the product being packaged. For example, in the first embodiment illustrated in FIGS. 1–11, the log conveyor 16 can have multiple-sided compartments that are conveyed along the wall 30 and in which loose or particulate matter is transported for packaging. Upon compression of such matter by the log compressor 18, the wall 30 can move and the wall 32 can be moved by the piston 34 to push the compressed matter into packaging material 36 between the log compression station 22 and a turret clamp 40.

One having ordinary skill in the art will also recognize that a number of the operations in the preferred embodiments described above can be performed in different manners while still falling within the spirit and scope of the present invention. For example, alternative embodiments of the illustrated embodiment in FIGS. 1–11 need not necessarily have turret clamps 40 that are retractable and extendable. In the first illustrated embodiment, the log compression system 12, wrap sealing system 54, and log discharge system 66 can be positioned within the apparatus so that the turret clamps 40 rotate upon the turret 38 into the above-described stations before these systems with minimal clearance and without requiring turret clamp extension or retraction.

Also, in the first illustrated embodiment, the turret clamps 40 need not necessarily have an actuator 52 for pushing out logs L from the turret clamps 40. Logs L compressed within the turret clamps 40 can be pulled therefrom via suction devices, jaws, and other conventional package manipulation devices. Especially where package compression is not required for the log discharge system 66, the turret clamps 40 can even be adjustable to widen the plates 48 and to permit logs L to slide or fall out of the turret clamps 40 to the log discharge system 66. In this regard, it should also be noted that the particular orientation of the turret 38 and the turret clamps 40 shown in FIGS. 1–11 is not required in the present invention, nor is the particular orientation of the shuttle 104 in FIGS. 12–15 required. The turret 38 can rotate about an axis placed in virtually any orientation (vertical, horizontal, or diagonally with respect to either such orientation). Similarly, the shuttle 104 in FIGS. 12–15 can be in any of these orientations, in which cases the orientation of the other log packaging apparatus components would be changed as necessary. For example, FIGS. 12–14 could represent a top view of a log packaging apparatus 110 according to the present invention.

In addition, any one or more of the various operations of the present invention can be performed manually, if desired. However, many embodiments of the present invention employ a system controller for automated operation of the various system components (e.g., in the first illustrated embodiment, the conveyor 16, log compressor 18, piston and wall 34, 32, wall 30, wrap material feed, turret 38, turret clamp extension and retraction, and conveyor assemblies 68).

Similarly, in the second illustrated embodiment, the sheet of wrapping material 108 used does not necessarily have to be a sleeve as described above. Instead, the packaging and wrapping material 108 in which each log L is placed can be sheeting, film or other type of wrap, one or more bands, straps, or other elongated members, a bag, a tube or any other wrappable packaging element or material.

Although the wrap conveyor 106 and the sheet feeding apparatus 164 is employed in the second illustrated embodiment (see FIGS. 12–15), it should be noted that either or both apparatuses 106, 164 (and their associated alternatives described above) can be employed in a turret-based system such as that of the first illustrated embodiment. In such cases, the sheet feeding apparatus 164 can operate to move sheets of wrap material 36 to the proper wrapping position as described above provided sufficient clearance exists between the turret clamps 40 and the log compression station 22 (whether the turret clamps 40 are retractable as described above or otherwise). It should also be noted that the system employed to move the shuttle 104 with respect to the log compression station 102 in the second illustrated embodiment can also be employed to move the turret 38 with respect to the log compression station 22 in the first illustrated embodiment (e.g., moving an axle or pivot about which the turret 38 rotates by employing any of the structures and elements described above for moving the shuttle carriage 144, moving a frame upon which such an axle or pivot is rotatably mounted in a similar manner, and the like).

What is claimed is:

1. A log wrapping apparatus for wrapping logs in wrap material, the log wrapping apparatus comprising:

a first station in which logs are received, the first station having a log compressor operable to compress the log in the first station;

a shuttle in which compressed logs are received from the first station, the shuttle movable along a path in forward and reverse directions toward and away from the first station;

a wrap conveyor translatable to convey a cut sheet of wrap material from a first position to a second position between the first station and the shuttle; and a log conveyor movable to convey a compressed log from the first station to the shuttle, the log conveyor movable to move the compressed log from the log compressor into the cut sheet of wrap material and toward the shuttle.

2. The log wrapping apparatus as claimed in claim 1, further comprising a wrap material staging location, wherein the wrap conveyor is translatable between a wrap conveyor position adjacent the wrap material staging location and said wrap conveyor second position in which the wrap material is located between the shuttle and the first station.

3. The log wrapping apparatus as claimed in claim 1, further comprising a wrap material source, wherein the wrap conveyor is translatable between a wrap conveyor position adjacent the wrap material source and said wrap conveyor second position in which the wrap material is located between the shuttle and the first station.

4. The log wrapping apparatus as claimed in claim 1, further comprising a wrap conveyor track along which the wrap conveyor is translatable between the first and second positions.

5. The log wrapping apparatus as claimed in claim 1, wherein the wrap conveyor includes a beam translatable between the first and second positions to move the wrap material to said second position between the first station and the shuttle.

6. The log wrapping apparatus as claimed in claim 1, wherein the wrap conveyor includes at least one gripper translatable to draw the wrap material into said second position between the shuttle and the first station.

7. The log wrapping apparatus as claimed in claim 1, wherein the log conveyor includes at least one conveyor belt movable to convey logs toward the shuttle.

8. The log wrapping apparatus as claimed in claim 1, wherein the log conveyor includes an actuator positioned to push logs from the first station toward the shuttle.

9. The log wrapping apparatus as claimed in claim 1, wherein the log conveyor includes at least one roller rotatable to convey logs toward the shuttle.

10. The log wrapping apparatus as claimed in claim 1, wherein the shuttle includes at least one guide positioned to receive logs from the first station, the at least one guide movable to convey logs within the shuttle.

11. The log wrapping apparatus as claimed in claim 1, further comprising an adhesive applicator positioned to apply adhesive to at least one of the log and the wrap material in the shuttle.

12. The log wrapping apparatus as claimed in claim 11, wherein the adhesive applicator at least partially defines a log sealing station of the shuttle.

13. The log wrapping apparatus as claimed in claim 1, wherein the shuttle includes at least one tucker movable to wrap a log in wrap material in the shuttle.

14. The log wrapping apparatus as claimed in claim 1, further comprising a track along which the shuttle is movable toward and away from the first station.

15. A log packaging apparatus for packaging a log within wrap material, the apparatus comprising:

a log compression station positioned to receive the log and operable to compress the log;

a shuttle translatable from a first position in which a first clearance exists between the shuttle and the log compression station and a second position in which a second clearance exists between the shuttle and the log compression station, the first clearance being greater than the second clearance;

a wrap conveyor translatable to convey a cut sheet of wrap material to a position between the log compression station and the shuttle; and a log conveyor positioned to move the compressed log from the log compression station into the cut sheet of wrap material and the shuttle.

16. The log wrapping apparatus as claimed in claim 15, further comprising a wrap material staging location, wherein the wrap conveyor is translatable between a wrap conveyor position adjacent the wrap material staging location and said wrap conveyor position in which the wrap material is located between the shuttle and the log compression station.

17. The log wrapping apparatus as claimed in claim 15, further comprising a wrap material source, wherein the wrap conveyor is translatable between a wrap conveyor position adjacent the wrap material source and said wrap conveyor position in which the wrap material is located between the shuttle and the log compression station.

18. The log packaging apparatus as claimed in claim 15, further comprising a wrap conveyor track along with the wrap conveyor is translatable to convey wrap material to the position between the log compressor and the shuttle.

19. The log packaging apparatus as claimed in claim 15, wherein the wrap conveyor includes at least one roller past which the wrap material translates to the position between the log compressor and the shuttle.

20. The log packaging apparatus as claimed in claim 15, wherein the wrap conveyor includes at least conveyor belt.

21. The log packaging apparatus as claimed in claim 15, wherein the wrap conveyor includes at least one gripper translatable to grip and retain the wrap material as the wrap material is translated to the position between the shuttle and the log compression station.

22. The log packaging apparatus as claimed in claim 15, wherein the log conveyor includes at least one actuator actuatable to push the log from the log compression station toward the shuttle.

23. The log packaging apparatus as claimed in claim 15, wherein the log conveyor includes at least one conveyor belt defining a part of the log compression station.

24. The log packaging apparatus as claimed in claim 15, wherein the log conveyor includes at least one roller defining a part of the log compression station, the at least one roller rotatable to move the log from the log compression station to the shuttle.

25. The log packaging apparatus as claimed in claim 15, further comprising a sealing station to which the log is moveable, the sealing station having at least one adhesive applicator positioned to apply adhesive to at least one of the log and the wrap material.

26. The log packaging apparatus as claimed in claim 25, wherein the adhesive applicator is coupled to the shuttle and the sealing station is defined at least in part by the shuttle.

27. The log packaging apparatus as claimed in claim 15, further comprising at least one tucker positioned to wrap a portion of the wrap material about the log in the shuttle.

* * * * *